US005503970A

United States Patent [19]

Olm et al.

[11] Patent Number: 5,503,970

[45] **Date of Patent: * Apr. 2, 1996**

[54] ULTRATHIN TABULAR GRAIN EMULSIONS WITH NOVEL DOPANT MANAGEMENT

[75] Inventors: Myra T. Olm, Webster; Xin Wen; Richard L. Daubendiek, both of Rochester; Donald L. Black, Webster; Joseph C. Deaton, Rochester; Timothy R. Gersey, Rochester; Joseph G. Lighthouse, Rochester; Robert D. Wilson, Rochester, all of N.Y.

[73] Assignee: Eastman Kodak Company, Rochester, N.Y.

[ * ] Notice: The portion of the term of this patent subsequent to Feb. 27, 2013, has been disclaimed.

[21] Appl. No.: 296,562

[22] Filed: Aug. 26, 1994

[51] Int. Cl.[6] ..... G03C 1/035; G03C 1/09

[52] U.S. Cl. ..... 430/567; 430/570; 430/599

[58] Field of Search ..... 435/567, 570, 435/599

[56] References Cited

U.S. PATENT DOCUMENTS

| | | | |
|---|---|---|---|
| 3,236,652 | 2/1966 | Kennard et al. | 430/607 |
| 4,435,501 | 3/1984 | Maskasky | 430/434 |
| 4,439,520 | 3/1984 | Kofron et al. | 430/434 |
| 4,888,273 | 12/1989 | Himmelwright et al. | 430/569 |
| 5,250,403 | 10/1993 | Antoniades et al. | 430/505 |
| 5,372,927 | 12/1994 | Delton | 430/569 |

OTHER PUBLICATIONS

Buhr et al, Research Disclosure, vol. 253, Item 25330, May 1985.

*Research Disclosure* vol. 308, Dec. 1989, Item 308119, Section I, Paragraph D.

*Primary Examiner*—Janet C. Baxter

*Attorney, Agent, or Firm*—Carl O. Thomas

[57] ABSTRACT

A chemically and spectrally sensitized ultrathin tabular grain emulsion is disclosed including tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, and (e) exhibiting an average thickness of less than 0.07 μm.

It has been observed that increased speed and contrast as well as improvements in speed-granularity relationships can be realized when the surface chemical sensitization sites include epitaxially deposited silver halide protrusions forming epitaxial junctions with the tabular grains, the protrusions (a) being located on up to 50 percent of the surface area of the tabular grains, (b) having a higher overall solubility than at least that portion of the tabular grains forming epitaxial junctions with the protrusions, and (c) forming a face centered cubic crystal lattice.

In further improving photographic performance by incorporating a photographically useful dopant, it has been observed that thinner tabular grains can be realized by locating the dopant in the protrusions. Still further improvements in photographic sensitivity can be realized by selecting the dopant to act as a shallow trap for photoelectrons.

23 Claims, No Drawings

ULTRATHIN TABULAR GRAIN EMULSIONS WITH NOVEL DOPANT MANAGEMENT

FIELD OF THE INVENTION

The invention relates to silver halide photography. More specifically, the invention relates to improved spectrally sensitized silver halide emulsions and to multilayer photographic elements incorporating one or more of these emulsions.

BACKGROUND

Kofron et al U.S. Pat. No. 4,439,520 ushered in the current era of high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional modifying compounds, such as metal compounds, were taught to be optionally present during grain precipitation.

.An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver halide epitaxy to selected sites, typically the edges and/or corners, of the host grains. Depending upon the composition and site of the silver salt epitaxy, significant increases in speed were observed. Modifying compounds were taught to be optionally incorporated either in the host tabular grains or in the salt halide epitaxy.

In 1982 the first indirect radiographic and color photographic films incorporating the teachings of Kofron et al were introduced commercially. Now, 12 years later, there are clearly understood tabular grain emulsion preferences that are different, depending on the type of product being considered. Indirect radiography has found exceptionally thin tabular grain emulsions to be unattractive, since they produce silver images that have an objectionably warm (i.e., brownish black) image tone. In camera speed color photographic films exceptionally thin tabular grain emulsions usually have been found attractive, particularly when spectrally sensitized to wavelength regions in which native grain sensitivity is low—e.g., at wavelengths longer than about 430 nm. Comparable performance of exceptionally thin tabular grain emulsions containing one or more spectral sensitizing dyes having an absorption peak of less than 430 nm is theoretically possible. However, the art has usually relied on the native blue sensitivity of camera speed emulsions to boost their sensitivity, and this has retarded the transition to exceptionally thin tabular grain emulsions for producing blue exposure records. Grain volume reductions that result from reducing the thickness of tabular grains work against the use of the native blue sensitivity to provide increases in blue speed significantly greater than realized by employing blue absorbing spectral sensitizing dyes. Hence, thicker tabular grains or nontabular grains are a common choice for the blue recording emulsion layers of camera speed film.

Recently, Antoniades et al U.S. Pat. No. 5,250,403 disclosed tabular grain emulsions that represent what were, prior to the present invention, in many ways the best available emulsions for recording exposures in color photographic elements, particularly in the minus blue (red and/or green) portion of the spectrum. Antoniades et al disclosed tabular grain emulsions in which tabular grains having {111} major faces account for greater than 97 percent of total grain projected area. The tabular grains have an equivalent circular diameter (ECD) of at least 0.7 μm and a mean thickness of less than 0.07 μm. Tabular grain emulsions with mean thicknesses of less than 0.07 μm are herein referred to as "ultrathin" tabular grain emulsions. They are suited for use in color photographic elements, particularly in minus blue recording emulsion layers, because of their efficient utilization of silver, attractive speed-granularity relationships, and high levels of image sharpness, both in the emulsion layer and in underlying emulsion layers.

A characteristic of ultrathin tabular grain emulsions that sets them apart from other tabular grain emulsions is that they do not exhibit reflection maxima within the visible spectrum, as is recognized to be characteristic of tabular grains having thicknesses in the 0.18 to 0.08 μm range, as taught by Buhr et al, *Research Disclosure,* Vol. 253, Item 25330, May 1985. *Research Disclosure* is published by Kenneth Mason Publications, Ltd., Dudley House, 12 North St., Emsworth, Hampshire P010 7DQ, England. In multilayer photographic elements overlying emulsion layers with mean tabular grain thicknesses in the 0.18 to 0.08 range require care in selection, since their reflection properties differ widely within the visible spectrum. The choice of ultrathin tabular grain emulsions in building multilayer photographic elements eliminates spectral reflectance dictated choices of different mean grain thicknesses in the various emulsion layers overlying other emulsion layers. Hence, the use of ultrathin tabular grain emulsions not only allows improvements in photographic performance, it also offers the advantage of simplifying the construction of multilayer photographic elements. As one alternative Antoniades et al contemplated the incorporation of ionic dopants in the ultrathin tabular grains as taught by *Research Disclosure,* Vol. 308, December 1989, Item 308119, Section I, Paragraph D. *Research Disclosure* is published by Kenneth Mason Publications, Ltd., Dudley House, 12 North St., Emsworth, Hampshire P010 7DQ, England.

RELATED PATENT APPLICATIONS

Daubendiek et al U.S. Serial No. 08/297,430, concurrently filed and commonly assigned, titled ULTRATHIN TABULAR GRAIN EMULSIONS CONTAINING SPEED-GRANULARITY ENHANCEMENTS, (Daubendiek et al II) observes in addition to the photographic performance advantages of Daubendiek et al I improvements in speed-granularity relationships attributable to the combination of chemical sensitizations including silver salt epitaxy and iodide distributions in the host tabular grains profiled so that the higher iodide host grain concentrations occur adjacent the corners and edges of the tabular grains and preferentially receive the silver salt epitaxy Daubendiek et al U.S. Serial No. 08/297,195, concurrently filed and commonly assigned, titled ULTRATHIN TABULAR GRAIN EMULSIONS WITH SENSITIZATION ENHANCEMENTS, (Daubendiek et al III) observes additional photographic advantages, principally increases in speed and contrast, to be realized when the iodide concentration of the silver halide epitaxy on silver iodobromide ultrathin tabular grains is increased.

PROBLEM TO BE SOLVED

Notwithstanding the many advantages of tabular grain emulsions in general and the specific improvements represented by ultrathin tabular grain emulsions and color photographic elements, including those disclosed by Antoniades et al, there has remained an unsatisfied need for performance improvements in ultrathin tabular grain emulsions heretofore unavailable in the art as well as photographic elements containing these emulsions and for alternative choices for constructing emulsions and photographic elements of the highest attainable performance characteristics for color photography.

In addition there is a need in the art for ultrathin tabular grain emulsions that are "robust", where the term "robust" is employed to indicate the emulsion remains close to aim (i.e., planned) photographic characteristics despite inadvertent manufacturing variances. It is not uncommon to produce photographic emulsions that appear attractive in terms of their photographic properties when produced under laboratory conditions only to find that small, inadvertent variances in manufacturing procedures result in large quantities of emulsions that depart from aim characteristics to such an extent they cannot satisfy commercial requirements. There is in the art a need for high performance tabular grain emulsions that exhibit high levels of robustness or aim inertia, varying little from aim photographic characteristics from one manufacturing run to the next.

In attempting to modify the performance of ultrathin tabular grain emulsions through the inclusion of dopants as taught by Antoniades et al a difficulty has arisen in that inclusion of dopants in the ultrathin grains during their precipitation can result in increasing the thickness of the tabular grains. Only by exercising care in the selection of the concentration and mode of introduction of the dopant can ultrathin properties be retained in the tabular grains. Even when precipitation conditions are chosen to produce ultrathin tabular grains in the presence of a dopant, the presence of a dopant can still contribute to significant grain thickening. Thus, there is a need for freedom to employ a full range of art recognized doping alternatives without incurring thickening of ultrathin tabular grains.

SUMMARY OF THE INVENTION

In one aspect this invention is directed to an improved emulsion comprised of (1) a dispersing medium, (2) silver halide grains including tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include silver halide protrusions forming epitaxial junctions with the tabular grains, the protrusions (a) being located on up to 50 percent of the surface area of the tabular grains, (b) having a higher overall solubility than at least that portion of the tabular grains forming epitaxial junctions with the protrusions, (c) forming a face centered cubic crystal lattice, and (d) including a photographically useful dopant.

In another aspect this invention is directed to a photographic element comprised of (i) a support, (ii) a first silver halide emulsion layer coated on the support and sensitized to produce a photographic record when exposed to specular light within the minus blue visible wavelength region of from 500 to 700 nm, and (iii) a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an improved emulsion according to the invention.

The improved ultrathin tabular grain emulsions of the present invention are the first to employ dopant modified silver halide epitaxy in their chemical sensitization. The present invention has been realized by (1) overcoming a bias in the art against applying silver halide epitaxial sensitization to ultrathin tabular grain emulsions, (2) observing improvements in performance as compared to ultrathin tabular grain emulsions receiving only conventional sulfur and gold sensitizations, (3) observing larger improvements in sensitivity than expected, based on similar sensitizations of thicker tabular grains, and (4) avoiding thickening of ultrathin grains by locating a dopant in the silver halide epitaxy rather than in the tabular grains.

Conspicuously absent from the teachings of Antoniades et al are demonstrations or suggestions of the suitability of silver halide epitaxial sensitizations of the ultrathin tabular grain emulsions therein disclosed. Antoniades et al was, of course, aware of the teachings of Maskasky I, but correctly observed that Maskasky I provided no explicit teaching or examples applying silver halide epitaxial sensitizations to ultrathin tabular grain emulsions. Having no original observations to rely upon and finding no explicit teaching of applying silver halide sensitization to ultrathin tabular grain emulsions, Antoniades et al was unwilling to speculate on the possible suitability of such sensitizations to the ultrathin tabular grain emulsions disclosed. The much larger surface to volume ratios exhibited by ultrathin tabular grains as compared to those employed by Maskasky I in itself was enough to raise significant doubt as to whether the ultrathin structure of the tabular grains could be maintained during epitaxial silver halide deposition. Further, it appeared intuitively obvious that the addition of silver halide epitaxy to ultrathin tabular grain emulsions would not improve image sharpness, either in the emulsion layer itself or in an underlying emulsion layer.

While Antoniades et al avoided silver halide epitaxial sensitization, Antoniades et al taught to dope the ultrathin tabular grains following conventional practices. Antoniades et al did not appreciate that dopants can contribute to tabular grain thickening. Further, having specifically avoided any teaching of silver halide epitaxial sensitization, Antoniades et al saw no other doping alternative, except to locate the dopant in the ultrathin tabular grains.

It has been discovered that chemical sensitizations including doped silver halide epitaxy are not only compatible with ultrathin host tabular grains, but that the resulting emulsions show improvements which were wholly unexpected, either in degree or in kind.

Unwanted thickening of ultrathin tabular grains is avoided by selectively doping the silver halide epitaxy in preference to the ultrathin tabular grains. The location of the dopant in the silver halide epitaxy has been shown to be fully compatible with improved photographic performance.

Increases in sensitivity imparted to ultrathin tabular grain emulsions by silver halide epitaxy have been observed to be larger than were expected based on the observations of Maskasky I employing thicker tabular host grains.

Additionally, the emulsions of the invention exhibit higher than expected contrasts.

At the same time, the anticipated unacceptable reductions in image sharpness, investigated in terms of specularity measurements, simply did not materialize, even when the quantities of silver salt epitaxy were increased well above the preferred maximum levels taught by Maskasky I.

Still another advantage is based on the observation of reduced unwanted wavelength absorption as compared to relatively thicker tabular grain emulsions similarly sensitized. A higher percentage of total light absorption was confined to the spectral region in which the spectral sensitizing dye or dyes exhibited absorption maxima. For minus blue sensitized ultrathin tabular grain emulsions native blue absorption was also reduced.

Finally, the emulsions investigated have demonstrated an unexpected robustness. It has been demonstrated that, when levels of spectral sensitizing dye are varied, as can occur during manufacturing operations, the silver salt epitaxially sensitized ultrathin tabular grain emulsions-of the invention exhibit less variance in sensitivity than comparable ultrathin tabular grain emulsions that employ only sulfur and gold sensitizers.

DESCRIPTION OF PREFERRED EMBODIMENTS

The invention is directed to an improvement in spectrally sensitized photographic emulsions. The emulsions are specifically contemplated for incorporation in camera speed color photographic films.

The emulsions of the invention can be realized by chemically and spectrally sensitizing any conventional ultrathin tabular grain emulsion in which the tabular grains (a) have {111} major faces;

(b) contain greater than 70 mole percent bromide, based on silver;

(c) account for greater than 90 percent of total grain projected area;

(d) exhibit an average ECD of at least 0.7 μm ; and (e) exhibit an average thickness of less than 0.07 μm.

Although criteria (a) through (e) are too stringent to be satisfied by the vast majority of known tabular grain emulsions, a few published precipitation techniques are capable of producing emulsions satisfying these criteria. Antoniades et al, cited above and here incorporated by reference, demonstrates preferred silver iodobromide emulsions satisfying these criteria. Zola and Bryant published European patent application 0 362 699 A3, also discloses silver iodobromide emulsions satisfying these criteria.

In referring to grains and emulsions containing more than one halide, the halides are named in their order of ascending concentration.

For camera speed films it is generally preferred that the tabular grains contain at least 0.25 (preferably at least 1.0) mole percent iodide, based on silver. Although the saturation level of iodide in a silver bromide crystal lattice is generally cited as about 40 mole percent and is a commonly cited limit for iodide incorporation, for photographic applications iodide concentrations seldom exceed 20 mole percent and are typically in the range of from about 1 to 12 mole percent.

As is generally well understood in the art, precipitation techniques, including those of Antoniades et al and Zola and Bryant, that produce silver iodobromide tabular grain emulsions can be modified to produce silver bromide tabular grain emulsions of equal or lesser mean grain thicknesses simply by omitting iodide addition. This is specifically taught by Kofron et al.

It is possible to include minor amounts of chloride ion in the ultrathin tabular grains. As disclosed by Delton U.S. Pat. No. 5,372,927, here incorporated by reference, and Delton U.S. Ser. No. 238,119, filed May 4, 1994, titled CHLORIDE CONTAINING HIGH BROMIDE ULTRATHIN TABULAR GRAIN EMULSIONS, both commonly assigned, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (° C.) boundaries of Curve A (preferably within the boundaries of Curve B) shown by Delton, corresponding to Curves A and B of Piggin et al U.S. Pat. Nos. 5,061,609 and 5,061,616, the disclosures of which are here incorporated by reference. Under these conditions of precipitation the presence of chloride ion actually contributes to reducing the thickness of the tabular grains.+ Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

For reasons discussed below in connection with silver halide epitaxy the ultrathin tabular grains accounting for at least 90 percent of total grain projected area contain at least 70 mole percent bromide, based on silver. These ultrathin tabular grains include silver bromide, silver iodobromide, silver chlorobromide, silver iodochlorobromide and silver chloroiodobromide grains. When the ultrathin tabular grains include iodide, the iodide can be uniformly distributed within the tabular grains. To obtain a further improvement in speed-granularity relationships it is preferred that the iodide distribution satisfy the teachings of Solberg et al U.S. Pat. No. 4,433,048, the disclosure of which is here incorporated by reference. The application of the iodide profiles of Solberg et al to ultrathin tabular grain emulsions is the specific subject matter of Daubendiek et al II, cited above. All references to the composition of the ultrathin tabular grains exclude the silver salt epitaxy.

The ultrathin tabular grains produced by the teachings of Antoniades et al, Zola and Bryant and Delton all have {111} major faces. Such tabular grains typically have triangular or hexagonal major faces. The tabular structure of the grains is attributed to the inclusion of parallel twin planes.

The tabular grains of the emulsions of the invention account for greater than 90 percent of total grain projected area. Ultrathin tabular grain emulsions in which the tabular grains account for greater than 97 percent of total grain projected area can be produced by the preparation procedures taught by Antoniades et al and are preferred. Antoniades et al reports emulsions in which substantially all (e.g., up to 99.8%) of total grain projected area is accounted for by tabular grains. Similarly, Delton reports that "substantially all" of the grains precipitated in forming the ultrathin tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area exhibit an average ECD of at least 0.7 μm. The advantage to be realized by maintaining the average ECD of at least 0.7 μm is demonstrated in Tables III and IV of Antoniades et al. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the ultrathin tabular grain emulsions of the invention the tabular grains accounting for greater than 90 percent of total grain projected area exhibit a mean thickness of less than 0.07 μm. At a mean grain thickness of 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by Antoniades et al these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of Antoniades et al, Kofron et al suggests a practical minimum tabular grain thickness about 0.01 μm.

Preferred ultrathin tabular grain emulsions are those in which grain to grain variance is held to low levels. Antoniades et al reports ultrathin tabular grain emulsions in which greater than 90 percent of the tabular grains have hexagonal major faces. Antoniades also reports ultrathin tabular grain emulsions exhibiting a coefficient of variation (COV) based on ECD of less than 25 percent and even less than 20 percent.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger ECD grains in the ultrathin tabular grain emulsions of the invention can produce a significant increase in emulsion granularity. Antoniades et al preferred low COV emulsions, since placing restrictions on COV necessarily draws the tabular grain ECD's present closer to the mean.

It is a recognition of this invention that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to modify the ultrathin tabular grain precipitation procedures taught by Antoniades et al to decrease selectively the size-frequency distribution of the ultrathin tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been discovered that disproportionate size range reductions in the size-frequency distributions of ultrathin tabular grains having greater than mean ECD's (hereinafter referred to as the $>ECD_{av.}$ grains) can be realized by modifying the procedure for precipitation of the ultrathin tabular grain emulsions in the following manner: Ultrathin tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed. Maskasky U.S. Pat. No. 4,713,320 (hereinafter referred to as Maskasky II), here incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky II employ reduce methionine below detectable limits. Examples of agents that have been employed for oxidizing the methionine in gelatino-peptizers include NaOCl, chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfonate of one of the following formulae:

$$R—SO_2S—M \quad (I)$$

$$R—SO_2S—R^1 \quad (II)$$

$$R—SO_2S—Lm—SSO_2—R^2 \quad (III)$$

where R, $R^1$ and $R^2$ are either the same or different and represent an aliphatic group, an aromatic group, or a heterocyclic group, M represents a cation, L represents a divalent linking group, and m is 0 or 1, wherein R, $R^1$, $R^2$ and L combine to form a ring. Gelatino-peptizers include gelatin—e.g., alkali-treated gelatin (cattle, bone or hide gelatin) or acid-treated gelatin (pigskin gelatin) and gelatin derivatives, e.g., acetylated or phthalated gelatin.

The chemical and spectral sensitizations of this invention improve upon the best chemical and spectral sensitizations disclosed by Maskasky I. In the practice of the present invention ultrathin tabular grains receive during chemical sensitization epitaxially deposited silver halide forming protrusions at selected sites on the ultrathin tabular grain surfaces. The protrusions exhibit a higher overall solubility than the silver halide forming at least those portions of the ultrathin tabular grains that serve as epitaxial deposition host sites—i.e., that form an epitaxial junction with the silver halide being deposited. By higher overall solubility it is meant that the average solubility of the silver halides forming the protrusions must be higher than the average solubility of the silver halides forming the host portions of the tabular grains. The solubility products, $K_{sp}$, of AgCl, AgBr and AgI in water at temperatures ranging from 0° to 100° C. are reported in Table 1.4, page 6, Mees, *The Theory of the Photographic Process,* 3rd Ed., Macmillan, New York (1966). For example, at 40° C., a common emulsion preparation temperature, the solubility product of AgCl is $6.22\times10^{-10}$, AgBr is $2.44\times10^{-12}$ and AgI is $6.95\times10^{-16}$. Because of the large differences of silver halide solubilities it is apparent that the epitaxially deposited silver halide must in the overwhelming majority of instances contain a lower iodide concentration than the portions of the host tabular grains on which epitaxial deposition occurs. Requiring the epitaxially deposited protrusions to exhibit a higher overall solubility than at least those portions of the ultrathin tabular grains on which they are deposited reduces displacement of halide ions from the ultrathin tabular grains, thereby avoiding degradation of the ultrathin configuration of the tabular grains.

Maskasky I observed that the double jet addition of silver and chloride ions during epitaxial deposition onto selected sites of silver iodobromide tabular grains produced the highest increases in photographic sensitivities. In the practice of the present invention it is contemplated that the silver halide protrusions will in all instances be precipitated to contain at least a 10 percent, preferably at least a 15 percent and optimally at least a 20 percent higher chloride concentration than the host ultrathin tabular grains. It would be more precise to reference the higher chloride concentration in the silver halide protrusions to the chloride ion concentration in the epitaxial junction forming portions of the ultrathin tabular grains, but this is not necessary, since the chloride ion concentrations of the ultrathin tabular grains are contemplated to be substantially uniform (i.e., to be at an average level) or to decline slightly due to iodide displacement in the epitaxial junction regions.

Contrary to the teachings of Maskasky I, it is the specific observation of Daubendiek et al III that improvements in photographic speed and contrast can be realized by adding iodide ions along with silver and chloride ions to the ultrathin tabular grain emulsions while performing epitaxial deposition. This results in increasing the concentration of iodide in the epitaxial protrusions above the low (substantially less than 1 mole percent) levels of iodide that migrate from the silver iodobromide host tabular grains during silver and chloride ion addition. Although any increase in the iodide concentration of the face centered cubic crystal lattice structure of the epitaxial protrusions improves photographic performance, it is preferred to increase the iodide concentration to a level of at least 1.0 mole percent, preferably at least 1.5 mole percent, based on the silver in the silver halide protrusions. The addition of bromide ions along with chloride and iodide ions increases the amounts of iodide that can be incorporated in the silver halide epitaxy while, surprisingly, increasing the level of bromide does not detract from the increases in photographic speed and contrast observed to result from increased iodide incorporations. The generally accepted solubilities of silver iodide in silver bromide and silver chloride is 40 and 13 mole percent, respectively, based on total silver, with mixtures of silver bromide and chloride accomodating intermediate amounts of silver iodide, depending on the molar ratio of Br:Cl. It is preferred that the silver iodide in the epitaxy be maintained at less than 10 mole percent, based on total silver in the epitaxy. It is further preferred that the overall solubility of the silver halide epitaxy remain higher than that of the portions of the ultrathin tabular grains serving as deposition sites for epitaxial deposition. The overall solubility of mixed silver halides is the mole fraction weighted average of the solubilities of the individual silver halides.

It is believed that the highest levels of photographic performance are realized when the silver halide epitaxy contains both (1) the large differences in chloride concentrations between the host ultrathin tabular grains and the epitaxially deposited protrusions noted above and (2) elevated levels of iodide inclusion in the face centered cubic crystal lattice structure of the protrusions.

Subject to the composition modifications specifically described above, preferred techniques for chemical and spectral sensitization can be similar to those described by Maskasky I, cited above and here incorporated by reference. Maskasky I reports improvements in sensitization by epitaxially depositing silver halide at selected sites on the surfaces of the host tabular grains. Maskasky I attributes the speed increases observed to restricting silver halide epitaxy deposition to a small fraction of the host tabular grain surface area. It is contemplated to restrict silver halide epitaxy to less than 50 percent of the ultrathin tabular grain surface area and, preferably, to a greater extent, as taught by Maskasky I. Specifically, Maskasky I teaches to restrict silver halide epitaxy to less than 25 percent, preferably less than 10 percent, and optimally less than 5 percent of the host grain surface area. When the ultrathin tabular grains contain a lower iodide concentration central region and a higher iodide laterally displaced region, as taught by Solberg et al and Daubendiek et al II, it is preferred to restrict the silver halide epitaxy to those portions of the ultrathin tabular grains that are formed by the laterally displaced regions, which; typically includes the edges and corners of the tabular grains.

When the iodide concentrations of different portions of the tabular grains differ, it is recognized that the iodide concentration of the epitaxial protrusions can be higher than the overall average concentration of the host ultrathin tabular grains without risking disruption of the ultrathin tabular grain structure, provided that the iodide concentrations of the portions of the tabular grains that provide the deposition sites of the epitaxial protrusions are higher than the iodide concentrations of the epitaxial protrusions.

Like Maskasky I, nominal amounts of silver halide epitaxy (as low as 0.05 mole percent, based on total silver, where total silver includes that in the host and epitaxy) are effective in the practice of the invention. Because of the increased host tabular grain surface area coverages by silver halide epitaxy discussed above and the lower amounts of silver in ultrathin tabular grains, an even higher percentage of the total silver can be present in the silver halide epitaxy. However, in the absence of any clear advantage to be gained by increasing the proportion of silver halide epitaxy, it is preferred that the silver halide epitaxy be limited to 50 percent of total silver. Generally silver halide epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver halide epitaxy that can be applied in forming ,the emulsions of this invention. Maskasky I teaches employing spectral sensitizing dyes that are in their aggregated form of adsorption to the tabular grain surfaces capable of direct silver halide epitaxy to the edges or corners of the tabular grains. Cyanine dyes that are adsorbed to host ultrathin tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

It is generally accepted that selective site deposition of silver halide epitaxy onto host tabular grains improves sensitivity by reducing sensitization site competition for conduction band electrons released by photon absorption on imagewise exposure. Thus, epitaxy over a limited portion of the major faces of the ultrathin tabular grains is more efficient than that overlying all or most of the major faces, still better is epitaxy that is substantially confined to the edges of the host ultrathin tabular grains, with limited coverage of their major faces, and still more efficient is epitaxy that is confined at or near the corners or other discrete sites of the tabular grains. The spacing of the corners of the major faces of the host ultrathin tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain. When the host ultrathin tabular grains contain a higher iodide concentration in laterally displaced regions, as taught by Solberg et al, it is recognized that enhanced photographic performance is realized by restricting silver halide protrusions to the higher iodide laterally displaced regions.

It is a specific recognition of this invention that improvements in photographic performance compatible with the advantages elsewhere described can be realized by incorporating a dopant in the silver halide epitaxy. As employed herein the term "dopant" refers to a material other than a silver or halide ion contained within the face centered cubic crystal lattice structure of the silver halide epitaxy. Whereas the introduction of dopants can in a variety of circumstances contribute to the thickening of ultrathin tabular grains during their precipitation, it has been observed that the placement of a dopant in the silver halide epitaxy avoids this disadvantage while at the same time realizing known dopant advantages.

Any conventional dopant known to be useful in a silver halide face centered cubic crystal lattice can be incorporated into the silver halide epitaxy. Photographically useful dopants selected from a wide range of periods and groups within the Periodic Table of Elements have been reported. As employed herein, references to periods and groups are based on the Periodic Table of Elements as adopted by the American Chemical Society and published in the *Chemical and Engineering News,* Feb. 4, 1985, p. 26. Conventional dopants include ions from periods 3 to 7 (most commonly 4 to 6) of the Periodic Table of Elements, such as Fe, Co, Ni, Ru, Rh, Pd, Re, Os, Ir, Pt, Mg, Al, Ca, Sc, Ti, V, Cr, Mn, Cu, Zn, Ga, Ge, As, Se, Sr, Y, Mo, Zr, Nb, Cd, In, Sn, Sb, Ba, La, W, Au, Hg, Tl, Pb, Bi, Ce and U. The dopants can be employed (a) to increase the sensitivity, (b) to reduce high or low intensity reciprocity failure, (c) to increase, decrease or reduce the variation of contrast, (d) to reduce pressure sensitivity, (e) to decrease dye desensitization, (f) to increase stability (including reducing thermal instability), (g) to reduce minimum density, and/or (h) to increase maximum density. For some uses any polyvalent metal ion is effective. The following are illustrative of conventional dopants capable of producing one or more of the effects noted above when incorporated in the silver halide epitaxy: B. H. Carroll, "Iridium Sensitization: A Literature Review", *Photographic Science and Engineering,* Vol. 24, No. 6, Nov./Dec. 1980, pp. 265–267; Hochstetter U.S. Pat. No. 1,951,933; De Witt U.S. Pat. No. 2,628,167; Spence et al U.S. Pat. No. 3,687,676 and Gilman et al U.S. Pat. No. 3,761,267; Ohkubo et al U.S. Pat. No. 3,890,154; Iwaosa et al U.S. Pat. No. 3,901,711; Yamasue et al U.S. Pat. No. 3,901,713; Habu et al U.S. Pat. No. 4,173,483; Atwell U.S. Pat. No. 4,269,927; Weyde U.S. Pat. No. 4,413,055; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Pat. No. 4,835,093; Leubner et al U.S. Pat. No. 4,902,611; Inoue et al U.S. Pat. No. 4,981,780; Kim U.S. Pat. No. 4,997,751; Shiba et al U.S. Pat. No. 5,057,402; Maekawa et al U.S. Pat. No. 5,134,060; Kawai et al U.S. Pat. No. 5,153,110; Johnson et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Bell U.S. Pat. Nos. 5,252,451 and 5,252,530; Komorita et al EPO 0 244 184; Miyoshi et al EPO 0 488 737 and 0 488 601; Ihama et al EPO 0 368 304; Tashiro EPO 0 405 938; Murakami et al EPO 0 509 674 and 0 563 946 and Japanese Patent Application Hei-211990]-249588 and Budz WO 93/02390.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, tellurocyanate, nitrosyl, thionitrosyl, azide, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781 and 5,037,732, Marchetti et al U.S. Pat. No. 4,937,180, Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320. Olm et al U.S. Pat. No. 5,360,712, the disclosure of which is here incorporated by reference, discloses hexacoordination complexes containing organic ligands while Bigelow U.S. Pat. No. 4,092,171 discloses organic ligands in Pt and Pd tetra-coordination complexes.

It is specifically contemplated to incorporate in the silver halide epitaxy a dopant to reduce reciprocity failure. Iridium is a preferred dopant for decreasing reciprocity failure. The teachings of Carroll, Iwaosa et al, Habu et al, Grzeskowiak et al, Kim, Maekawa et al, Johnson et al, Asami, Yoshida et al, Bell, Miyoshi et al, Tashiro and Murakami et al EPO 0 509 674, each cited above, are here incorporated by reference. These teachings can be applied to the emulsions of the invention merely by incorporating the dopant in the silver halide epitaxy.

In another specifically preferred form of the invention it is contemplated to incorporate in the face centered cubic crystal lattice structure of the silver halide forming the protrusions a dopant capable of increasing photographic speed by forming shallow electron traps. When a photon is absorbed by a silver halide grain, an electron (hereinafter referred to as a photoelectron) is promoted from the valence band of the silver halide crystal lattice to its conduction band, creating a hole (hereinafter referred to as a photo-hole) in the valence band. To create a latent image site within the grain, a plurality of photoelectrons produced in a single imagewise exposure must reduce several silver ions in the crystal lattice to form a small cluster of $Ag^{\circ}$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the silver halide epitaxy to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^{+}$) in the crystal lattice structure. The substitution of a divalent cation, for example, for the monovalent $Ag^{+}$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics,* Vol. 37 (1988) p. 395 and *Excitonic Processes in Solids* by M. Ueta, H. Kanzaki, K. Kobayashi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to Hg+l), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice However, coordination complexes of these Group VIII metal ions as well as $Ga^{+}3$ and $In^{+}3$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectro-chemical series of ligands, derived from the absorption spectra of metal ion complexes in solution, referenced in *Inorganic Chemistry: Principles of Structure and Reactivity,* by James E. Huheey, 1972, Harper and Row, New York and in *Absorption Spectra and Chemical Bonding in Complexes* by C. K. Jorgensen, 1962, Pergamon Press, London. From these references the following order of ligands in the spectrochemical series is apparent:

$I^- < Br^- < S^{-2} < \underline{S}CN^- < Cl^- < NO_3^- < F^- < \underline{O}H < ox^{-2} < H_2\underline{O} < \underline{N}CS^- < CH_3C\underline{N}^- < \underline{N}H_3 <$ en $<$ dipy $<$ phen $< \underline{N}O_2^- <$ phosph $<< \underline{C}N^- < \underline{C}O$.

The abbreviations used are as follows: ox= oxalate, dipy= dipyridine, phen= o-phenathroline, and phosph= 4-methyl-2,6,7-trioxa-1-phosphabicyclo[2.2.2octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $\underline{C}N^-$ and $\underline{C}O$ are especially preferred. Other preferred ligands are thiocyanate ($\underline{N}CS^-$), seleno-cyanate ( $\underline{N}CSe^-$), cyanate ($\underline{N}CO^-$), tellurocyanate ($\underline{N}CTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < Co^{+2} < Fe^{+2} < Cr+3 \approx$$

$$V^{+3} < CO^{+3} < Mn^{+4} < Mo^{+3} < Rh^{+3} \approx$$

$$Ru^{+3} < Pd^{+4} < IR^{+3} < Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experi-mental Techniques,* 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi* (b), Vol. 152 (1989), pp. 583–592, in a AgCl crystal the g factor of the electron EPR signal is 1.88± 0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K., respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are preferred coordination complexes for use in the practice of this invention. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion in the protrusions are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-211990]-249588, the disclosures of which are here incorporated by reference. Useful neutral and anionic organic ligands for hexacoordination U.S. Pat. No. 5,360,712, the disclosure of which is here incorporated by reference. Careful scientific investigations have revealed Group VIII hexahalo coordination complexes to create deep (desensitizing) electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) .

In a specific, preferred form it is contemplated to employ as a dopant a hexacoordination complex satisfying the formula:

$$[ML_6]^n \quad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[RU(CN)_5(N_3)]^{-4}$ |
| SET-18 | $IOS(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[OS(CN)Cl_5]^{-4}$ |
| SET-24 | $[CO(CN)_6]^{-3}$ |
| SET-25 | $[IrCl_4(oxalate)]^{-4}$ |
| SET-26 | $[In(NCS)_6]^{-3}$ |
| SET-27 | $[Ga(NCS)_6]^{-3}$ |

It is additionally contemplated to employ oligomeric coordination complexes to increase speed, as taught by Evans et al U.S. Pat. No. 5,024,931, the disclosure of which is here incorporated by reference.

The dopants are effective in conventional concentrations, where concentrations are based on the total silver, including both the silver in the tabular grains and the silver in the protrusions. Generally shallow electron trap forming dopants are contemplated to be incorporated in concentrations of at least $1\times 10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole. It is, of course, possible to distribute the dopant so that a portion of it is incorporated in the ultrathin tabular grains and the remainder is incorporated in the silver halide protrusions; however, this is not preferred. The advantages of placing the dopant in the silver halide protrusions are (1) the risk of dopant contributing to thickening of the ultrathin tabular grains is eliminated and (2) by locating the dopant in the protrusions it is placed near the site of latent image formation, which generally occurs at or near the junction of the protrusions with the ultrathin tabular grains. Locating the dopant near the site of latent image formation increases the effectiveness of the dopant.

Silver halide epitaxy can by itself increase photographic speeds to levels comparable to those produced by substantially optimum chemical sensitization with sulfur and/or gold. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure* Dec. 1989, Item 308119, Section III. Chemical sensitization. Kofron et al illustrates the application of these sensitizations to tabular grain emulsions.

A specifically preferred approach to silver halide epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

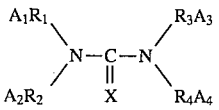

(V)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl- 1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VI)}$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver halide epitaxial deposition. Maskasky I teaches the use of J-aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes are available. The spectral sensitizing dyes disclosed by Kofron et al, particularly the blue spectral sensitizing dyes shown by structure and their longer methine chain analogous that exhibit absorption maxima in the green and red portions of the spectrum, are particularly preferred for incorporation in the ultrathin tabular grain emulsions of the invention. The selection of J-aggregating blue absorbing spectral sensitizing dyes for use as site directors is specifically contemplated. A general summary of useful spectral sensitizing dyes is provided by *Research Disclosure,* Dec. 1989, Item 308119, Section IV. Spectral sensitization and desensitization, A. Spectral sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an ultrathin tabular grain according to the invention after chemical sensitization has been completed.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of the invention emulsions produce very large speed increases. This is in part attributable to relatively lower mean grain volumes and in part to the relatively higher mean grain surface areas available for spectral sensitizing dye adsorption.

Aside from the features of spectral sensitized, silver halide epitaxy sensitized ultrathin tabular grain emulsions described above, the emulsions of this invention and their preparation can take any desired conventional form. For example, in accordance with conventional practice, after a novel emulsion satisfying the requirements of the invention has been prepared, it can be blended with one or more other novel emulsions according to this invention or with any other conventional emulsion. Conventional emulsion blending is illustrated in *Research Disclosure* Item 308119, cited above, Section I, Paragraph I, the disclosure of which is here incorporated by reference.

The emulsions once formed can be further prepared for photographic use by any convenient conventional technique. Additional conventional features are illustrated by *Research Disclosure* Item 308119, cited above, Section II, Emulsion washing; Section VI, Antifoggants and stabilizers; Section VII, Color materials; Section VIII, Absorbing and scattering materials; Section IX, Vehicles and vehicle extenders; X, Hardeners; XI, Coating aids; and XII, Plasticizers and lubricants; the disclosure of which is here incorporated by reference. The features of VII–XII can alternatively be provided in other photographic element layers.

The novel epitaxial silver halide sensitized ultrathin tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one important aspect this invention is directed to a photographic element containing at least two superimposed radiation sensitive silver halide emulsion layers coated on a conventional photographic support of any convenient type. Exemplary photographic supports are summarized by *Research Disclosure,* Item 308119, cited above, Section XVII, here incorporated by reference. The emulsion layer coated nearer the support surface is spectrally sensitized to produce a photographic record when the photographic element is exposed to specular light within the minus blue portion of the visible spectrum. The term "minus blue" is employed in its art recognized sense to encompass the green and red portions of the visible spectrum—i.e., from 500 to 700 nm. The term "specular light" is employed in its art recognized usage to indicate the type of spatially oriented light supplied by a camera lens to a film surface in its focal plane—i.e., light that is for all practical purposes unscattered.

The second of the two silver halide emulsion layers is coated over the first silver halide emulsion layer. In this arrangement the second emulsion layer is called upon to perform two entirely different photographic functions. The first of these functions is to absorb at least a portion of the light wavelengths it is intended to record. The second emulsion layer can record light in any spectral region ranging from the near ultraviolet (≧300 nm) through the near infrared (≦1500 nm). In most applications both the first and second emulsion layers record images within the visible spectrum. The second emulsion layer in most applications records blue or minus blue light and usually, but not necessarily, records light of a shorter wavelength than the first emulsion layer. Regardless of the wavelength of recording contemplated, the ability of the second emulsion layer to provide a favorable balance of photographic speed and image structure (i.e., granularity and sharpness) is important to satisfying the first function.

The second distinct function which the second emulsion layer must perform is the transmission of minus blue light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

How the overlying (second) emulsion layer can cause unsharpness in the underlying (first) emulsion layer is explained in detail by Antoniades et al, incorporated by reference, and hence does not require a repeated explanation.

It has been discovered that a favorable combination of photographic sensitivity and image structure (e.g., granularity and sharpness) are realized when silver halide epitaxy sensitized ultrathin tabular grain emulsions satisfying the requirements of the invention are employed to form at least the second, overlying emulsion layer. It is surprising that the presence of silver halide epitaxy on the ultrathin tabular grains of the overlying emulsion layer is consistent with observing sharp images in the first, underlying emulsion layer. Obtaining sharp images in the underlying emulsion layer is dependent on the ultrathin tabular grains in the overlying emulsion layer accounting for a high proportion of total grain projected area; however, grains having an ECD of less than 0.2 μm, if present, can be excluded in calculating total grain projected area, since these grains are relatively optically transparent. Excluding grains having an ECD of less than 0.2 μm in calculating total grain projected area, it is preferred that the overlying emulsion layer containing the silver halide epitaxy sensitized ultrathin tabular grain emulsion of the invention account for greater than 97 percent, preferably greater than 99 percent, of the total projected area of the silver halide grains.

Except for the possible inclusion of grains having an ECD of less than 0.2 μm (hereinafter referred to as optically transparent grains), the second emulsion layer consists almost entirely of ultrathin tabular grains. The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 97% and optimally greater than 99% of total grain projected area are satisfied excluding only grains having ECD's of less than 0.1 (optimally 0.05) μm. Thus, in the photographic elements of the invention, the second emulsion layer can consist essentially of tabular grains contributed by the ultrathin tabular grain emulsion of the invention or a blend of these tabular grains and optically transparent grains. When optically transparent grains are present, they are preferably limited to less than 10 percent and optimally less than 5 percent of total silver in the second emulsion layer.

The advantageous properties of the photographic elements of the invention depend on selecting the grains of the emulsion layer overlying a minus blue recording emulsion layer to have a specific combination of grain properties. First, the tabular grains contain photographically significant levels of iodide. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of minus blue light when coupled with an average ECD of at least 0.7 μm and an average grain thickness of less than 0.07 μm. The mean ECD of at least 0.7 μm is, of course, advantageous apart from enhancing the specularity of light transmission in allowing higher levels of speed to be achieved in the second emulsion layer. Third, employing ultrathin tabular grains makes better use of silver and allows lower levels of granularity to be realized. Finally, the presence of silver halide epitaxy allows unexpected increases in photographic sensitivity to be realized.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to following specific examples of emulsion preparations, emulsions and photographic elements satisfying the requirements of the invention. Photographic speeds are reported as relative log speeds, where a speed difference of 30 log units equals a speed difference of 0.3 log E, where E represents exposure in lux-seconds. Contrast is measured as mid-scale contrast. Halide ion concentrations are reported as mole percent (M %), based on silver.

Ultrathin Emulsion A

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin was quickly oxidized by addition of 128 mg of Oxone™ ($2KHSO_5.KHSO_4.K_2SO_4$, purchased from Aldrich) in 20 cc of water, and the temperature was raised to 54° C. in 9 min. After the reactor and its contents were held at this temperature for 9 min, 100 g of oxidized methionine lime-processed bone gelatin dissolved in 1.5 L $H_2O$ at 54° C. were added to the reactor. Next the pH was raised to 5.90, and 122.5 cc of 1M NaBr were added to the reactor. Twenty four and a half minutes after nucleation the growth stage was begun during which 2.5 M $AgNO_3$, 2.8M NaBr, and a 0.148M suspension of AgI (Lippmann) were added in proportions to maintain (a) a uniform iodide level of 4.125M % in the growing silver halide crystals and (b) the reactor pBr at the value resulting from the cited NaBr additions prior to the start of nucleation and growth, until 0.848 mole of silver iodobromide had formed (53.33 min, constant flow rates), at which time the excess $Br^-$ concentration was increased by addition of 105 cc of 1M NaBr; the reactor pBr was maintained at the resulting value for the balance of the growth. The flow of the cited reactants was then resumed and the flow was accelerated such that the final flow rate at the end of the segment was approximately 12.6 times that at the beginning; a total of 9 moles of silver iodobromide (4.125M %I) was formed. When addition of $AgNO_3$, AgI and NaBr was complete, the resulting emulsion was coagulation washed and the pH and pBr were adjusted to storage values of 6 and 2.5, respectively.

The resulting emulsion was examined by scanning electron micrography (SEM). More than 99.5 % of the total grain projected area was accounted for by tabular grains. The mean ECD of the emulsion grains 1.89 μm, and their COV was 34. Since tabular grains accounted for very nearly all of the grains present, mean grain thickness was determined using a dye adsorption technique: The level of 1,1'-diethyl-2,2'-cyanine dye required for saturation coverage was determined, and the equation for surface area was solved assuming the solution extinction coefficient of this dye to be 77,300 L/mole-cm and its site area per molecule to be 0.566 $nm^2$.

This approach gave a mean grain thickness value of 0.053 μm.

Thin Emulsion B

This emulsion was precipitated exactly as Emulsion A to the point at which 9 moles of silver iodobromide had been formed, then 6 moles of the silver iodobromide emulsion were taken from the reactor. Additional growth was carried out on the 3 moles which were retained in the reactor to serve as seed crystals for further thickness growth. Before initiating this additional growth, 17 grams of oxidized methionine lime-processed bone gelatin in 500 cc water at 54° C. was added, and the emulsion pBr was reduced to ca. 3.3 by the slow addition of $AgNO_3$ alone until the pBr was about 2.2, followed by an unbalanced flow of $AgNO_3$ and NaBr. While maintaining this high pBr value and a temperature of 54° C., the seed crystals were grown by adding $AgNO_3$ and a mixed halide salt solution that was 95.875M % NaBr and 4.125M % KI until an additional 4.49 moles of silver iodobromide (4.125M %I) was formed; during this growth period, flow rates were accelerated 2× from start to finish. The resulting emulsion was coagulation washed and stored similarly as Emulsion A.

The resulting emulsion was examined similarly as Emulsion A. More than 99.5% of the total grain projected area was provided by tabular grains. The mean ECD of this emulsion was 1.76 μm, and their COV was 44. The mean thickness of the emulsion grains, determined from dye adsorption measurements like those described for Emulsion A, was 0.130 μm.

Sensitizations

Samples of the emulsions were next sensitized with and without silver salt epitaxy being present.

Epitaxial Sensitization Procedure

A 0.5 mole sample of the emulsion was melted at 40° C. and its pBr was adjusted to ca. 4 with a simultaneous addition of $AgNO_3$ and KI solutions in a ratio such that the small amount of silver halide precipitated during this adjustment was 12% I. Next, 2M % NaCl (based on the original amount of silver iodobromide host) was added, followed by addition of spectral sensitizers Dye 1 [anhydro-9-ethyl-5', 6'-dimethyoxy-5-phenyl- 3'-(3-sulfopropyl)-3-(3-sulfobutyl)oxathiacarbocyanine hydroxide] and Dye 2 [anhydro-5,5'-di-chloro- 9-ethyl-3,3'-bis(3-sulfopropyl)thiacarbocyanine hydroxide, sodium salt], after which 6M % AgCl epitaxy was formed by a balanced double jet addition of $AgNO_3$ and NaCl solutions. This procedure produced epitaxial growths mainly on the corners and edges of the host tabular grains.

The epitaxially sensitized emulsion was split into smaller portions in order to determine optimal levels of subsequently added sensitizing components, and to test effects of level variations. The post-epitaxy components included additional portions of Dyes 1 and 2, 60 mg NaSCN/mole Ag, $Na_2S_2O_3.5H_2O$ (sulfur), $KAuCl_4$ (gold), and 11.44 mg 1-(3-acetamidophenyl)-5-mercaptotetrazole (APMT)/mole Ag. After all components were added the mixture was heated to 60° C. to complete the sensitization, and after cool-down, 114.4 mg additional APMT was added.

The resulting sensitized emulsions were coated on a cellulose acetate film support over a gray silver antihalation layer, and the emulsion layer was overcoated with a 4.3 $g/m^2$ gelatin layer containing surfactant and 1.75 percent by weight, based on total weight of gelatin, of bis(vinylsulfonyl)methane hardener. Emulsion laydown was 0.646 g $Ag/m^2$ and this layer also contained 0.323 $g/m^2$ and 0.019 $g/m^2$ of Couplers 1 and 2, respectively, 10.5 $mg/m^2$ of 4-hydroxy- 6-methyl-1,3,3a,7-tetraazaindene ($Na^+$ salt), and 14.4 $mg/m^2$ 2-(2-octadecyl)-5-sulfohydroquinone ($Na^+$ salt), surfactant and a total of 1.08 g gelatin/$m^2$. The emulsions so coated were given 0.01 sec Wratten 23A™ filtered (wavelengths >560 nm transmitted) daylight balanced light exposures through a calibrated neutral step tablet, and then were developed using the color negative Kodak Flexicolor™ C41 process. Speed was measured at a density of 0.15 above minimum density.

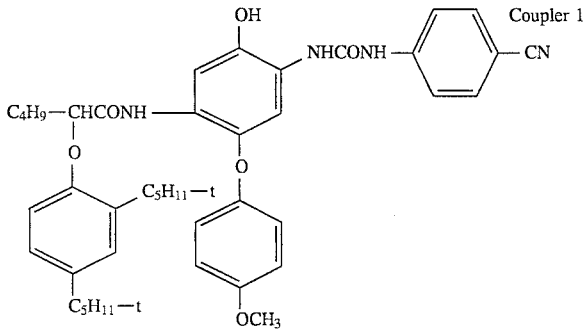

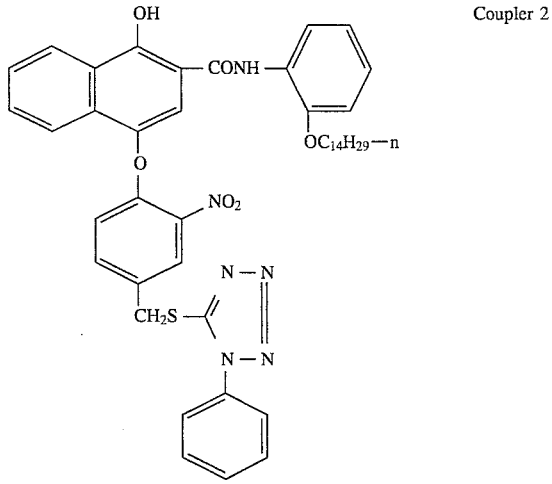

Nonepitaxial Sensitization Procedure

This sensitization procedure was similar to that described for epitaxial sensitizations, except that the epitaxial deposition step was omitted. Thus after adjusting the initial pBr to ca. 4, suitable amounts of Dye 1 and Dye 2 were added, then NaSCN, sulfur, gold and APMT were added as before, and this was followed by a heat cycle at 60° C.

Optimization

Beginning levels for spectral sensitizing dye, sulfur and gold sensitizers were those known to be approximately optimal from prior experience, based on mean grain ECD and thickness. Sensitization experiments were then conducted in which systematic variations were made in levels of dye, sulfur and gold. Reported below in Tables I and II are the highest speeds that were observed in sensitizing the thin and ultrathin tabular grain emulsions A and B, respectively. In Table III the contrasts are reported of the epitaxially sensitized thin and ultrathin tabular grain emulsions A and B reported in Tables I and II.

TABLE I

Speed Increase Attributable to Epitaxy on Thin Host Tabular Grains

| Host Emulsion | Type of Sensitization | Dmin | Relative Log Speed |
|---|---|---|---|
| Emulsion B | Nonepitaxial | 0.11 | 100 |
| Emulsion B | Epitaxial | 0.15 | 130 |

TABLE II

Speed Increase Attributable to Epitaxy on Ultrathin Tabular Grains

| Host Emulsion | Type of Sensitization | Dmin | Relative Log Speed |
|---|---|---|---|
| Emulsion A | Nonepitaxial | 0.14 | 100 |
| Emulsion A | Epitaxial | 0.15 | 150 |

TABLE III

Contrast Comparisons of Epitaxially Sensitized Thin and Ultrathin Tabular Emulsions.

| Host Emulsion | Emulsion Type | Sensitization | Contrast |
|---|---|---|---|
| Emulsion B | Thin | Epitaxial | 0.68 |
| Emulsion A | Ultrathin | Epitaxial | 0.89 |

Tables I and II demonstrate that the speed gain resulting from epitaxial sensitization of an ultrathin tabular grain emulsion is markedly greater than that obtained by a comparable epitaxial sensitization of a thin tabular grain emulsion. Table III further demonstrates that the epitaxially sensitized ultrathin tabular grain emulsion further exhibits a higher contrast than the similarly sensitized thin tabular grain emulsion.

Specularity Comparisons

The procedure for determining the percent normalized specular transmittance of light through coatings of emulsions as outlined in Antoniades et al Example 6 was employed. Table IV summarizes data for the spectrally and epitaxially sensitized thin and ultrathin tabular emulsions described above in terms of percent normalized specular transmittance (% NST), with normalized specular transmittance being the ratio of the transmitted specular light to the total transmitted light. The percent transmittance and the percent normalized specular transmittance at either 550 nm or 450 nm were plotted versus silver laydown. The silver laydown corresponding to 70 percent total transmittance was determined from these plots and used to obtain the percent specular transmittance at both 550 and 450 nm.

TABLE IV

Specularity Comparisons

| Host Emulsion | Sp. Sens. Dyes | M % AgCl Epitaxy | % NST 450 nm | % NST 550 nm |
|---|---|---|---|---|
| thin Emulsion B | 1 & 2 | 6 | 20.7 | 18.6 |
| ultrathin Emulsion A | 1 & 2 | 6 | 70.7 | 71.6 |

From Table IV it is apparent that epitaxially sensitized ultrathin tabular grain emulsions exhibit a dramatic and surprising increase in percentage of total transmittance accounted for by specular transmittance as compared to thin tabular grain emulsions.

Spectrally Displaced Absorptions

The same coatings reported in Table IV that provided 70 percent total transmittance at 550 nm were additionally examined to determine their absorption at shorter wavelengths as compared to their absorption at the peak absorption wavelength provided by Dyes 1 and 2, which was 647 nm. The comparison of 600 nm absorption to 647 nm absorption is reported in Table V, but it was observed that absorptions at all off-peak wavelengths are lower with epitaxially sensitized ultrathin tabular grain emulsions than with similarly sensitized thin tabular grain emulsions.

TABLE V

| Host Emulsion | Dyes | Mole % Epitaxy | Relative Absorption A600/A647 |
|---|---|---|---|
| Relative Off-Peak Absorption | | | |
| thin Emulsion B | 1 & 2 | 6 | 0.476 |
| ultrathin Emulsion A | 1 & 2 | 6 | 0.370 |

From Table V it is apparent that the spectrally and epitaxially sensitized ultrathin tabular grain emulsion exhibited significantly less off-peak absorption than the compared similarly sensitized thin tabular grain emulsion.

Emulsion C

This emulsion was prepared in a manner similar to that described for Emulsion A, but with the precipitation procedure modified to provide a higher uniform iodide concentration ($AgBr_{0.88}I_{0.12}$) during growth and a smaller grain size.

Measuring grain parameters similarly as for Emulsion A, it was determined that in Emulsion C 99.4% of the total grain projected area was provided by tabular grains, the mean grain ECD was 0.95 μm (COV= 61), and the mean grain thickness was 0.049 μm.

Specularity as a Function of Epitaxial Levels

Formation of AgCl epitaxy on the host ultrathin tabular grains of Emulsion C followed the general procedure described above for epitaxial sensitizations with flow rates typically such that 6 mole-% epitaxy formed per min, or higher. The emulsion samples were not sulfur or gold sensitized, since these sensitizations have no significant influence on specularity. In addition to spectral sensitizing Dye 2, the following alternative spectral sensitizing dyes were employed:

Dye 3: Anhydro-6,6'-dichloro-1,1'-diethyl-3,3'-bis( 3-sulfopropyl)-5,5'-bis(trifluoromethyl)benz-imidazole carbocyanine hydroxide, sodium salt;

Dye 4: Anhydro-5-chloro-9-ethyl-5'-phenyl-3'-(3-sulfobutyl)- 3-(3-sulfopropyl)oxacarbocyanine hydroxide, triethylammonium salt;

Dye 5: Anhydro-5,5'-dichloro-3,3'-bis(3-sulfopropyl)thiacyanine hydroxide, triethylammonium salt.

Since epitaxial deposition produces stoichiometric related amounts of sodium nitrate as a reaction by-product, which, if left in the emulsion when coated, could cause a haziness that could interfere with optical measurements, these epitaxially treated emulsions were all coagulation washed to remove such salts before they were coated.

TABLE VI

The Effect of Differing Levels of Epitaxy on the Specularity of Ultrathin Tabular Grain Emulsions

| Dye(s) | Mole % Epitaxy | % NST 450 nm | % NST 550 nm | % NST 650 nm |
|---|---|---|---|---|
| 2 | 0 | 71.4 | 68.4 | — |
| 2 | 12 | 65.7 | 67.0 | — |
| 2 | 24 | 65.7 | 61.4 | — |
| 2 | 36 | 64.0 | 64.3 | — |
| 2 | 100 | 50.7 | 52.9 | — |
| 3 & 4 | 0 | — | — | 59.3 |
| 3 & 4 | 12 | — | — | 57.1 |
| 5 | 0 | — | 62.9 | 60.9 |
| 5 | 12 | — | 57.6 | 57.7 |

Data in Table VI show that specularity observed for the host emulsion lacking epitaxy is decreased only slightly after epitaxy is deposited. Even more surprising is the high specularity that is observed with high levels of epitaxy. Note that specularity at 450 and 550 nm remains high as the level of epitaxy is increased from 0 to 100%. The percent normalized specular transmittance compares favorably with that reported by Antoniades et al in Table IV, even though Antoniades et al did not employ epitaxial sensitization. It is to be further noted that the acceptable levels of specular transmittance are achieved even when the level of epitaxy is either higher than preferred by Maskasky I or even higher than taught by Maskasky I to be useful.

Robustness Comparisons

To determine the robustness of the emulsions of the invention Emulsion A was sulfur and gold sensitized, with an without epitaxial sensitization, similarly as the emulsions reported in Table II, except that the procedure for optimizing sensitization was varied so that the effect of having slightly more or slightly less spectral sensitizing dye could be judged.

A preferred level of spectral sensitizing dye and sulfur and gold sensitizers was arrived at in the following manner: Beginning levels were selected based on prior experience with these and similar emulsions, so that observations began with near optimum sensitizations. Spectral sensitizing dye levels were varied from this condition to pick a workable optimum spectral sensitizing dye level, and sulfur and gold sensitization levels were then optimized for this dye level. The optimized sulfur ($Na_2S_2O_3.5H_2O$) and gold ($KAuCl_4$) levels were 5 and 1.39 mg/Ag mole, respectively.

With the optimized sulfur and gold sensitization selected, spectral sensitizing dye levels were varied to determine the degree to which differences in dye level affected emulsion sensitivity. The results are summarized in Table VII.

TABLE VII

Robustness Tests: Ultrathin Tabular Grain Emulsions Optimally Sulfur and Gold Sensitized Without Epitaxy

| Description | Dye 1 mM/Ag M | Dye 2 mM/Ag M | Rel. Speed | Dmin | Δ Speed |
|---|---|---|---|---|---|
| Mid Dye | 0.444 | 1.731 | 100 | 0.14 | check |
| High Dye | 0.469 | 1.827 | 117 | 0.14 | +17 |
| Low Dye | 0.419 | 1.629 | 84 | 0.15 | −16 |

For each one percent change in dye concentration speed varied 2.73 log speed units. When the speed variance was examined on a second occasion, a one percent concentration variance in spectral sensitizing dye resulted in a speed variation of 4.36 log speed units. The run to run variance merely served to reinforce the observed lack of robustness of the emulsions lacking epitaxy.

The experiments reported above were repeated, except that Emulsion A additionally received an epitaxial sensitization similarly as the epitaxialy sensitized emulsion in Table II. The optimized sulfur ($Na_2S_2O_3.5H_2O$) and gold ($KAuCl_4$) levels were 2.83 and 0.99 mg/Ag mole, respectively. The results are summarized in Table VIII below:

TABLE VIII

Robustness Tests: Ultrathin Tabular Grain Emulsions Optimally Sulfur and Gold Sensitized With Epitaxy

| Description | Dye 1 mM/Ag M | Dye 2 mM/Ag M | Rel. Speed | Dmin | Δ Speed |
|---|---|---|---|---|---|
| Mid Dye | 0.444 | 1.73 | 100 | 0.14 | check |
| High Dye | 0.469 | 1.83 | 107 | 0.15 | +7 |
| Low Dye | 0.419 | 1.63 | 91 | 0.13 | −9 |

For each one percent change in dye concentration speed varied only 1.31 log speed units. This demonstrated a large and unexpected increase in the robustness of the epitaxially sensitized ultrathin tabular grain emulsion.

IODIDE PROFILES

This series of comparisons is provided for the purpose of demonstrating the speed-granularity relationship enhancements that are contributed by providing iodide profiles in the epitaxially sensitized ultrathin tabular grains that satisfy the requirements of the invention.

Emulsion D (Uniform 1.5M % Iodide)

A vessel equipped with a stirrer was charged with 6 L of water containing 3.75 g lime-processed bone gelatin that had not been treated with oxidizing agent to reduce its methionine content, 4.12 g NaBr, an anti-foamant, and sufficient sulfuric acid to adjust pH to 1.8, at 39° C. During nucleation, which was accomplished by balanced simultaneous 4 sec. addition of $AgNO_3$ and halide (98.5 and 1.5 mole-% NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin was quickly oxidized by addition of 128 mg of Oxone™ ($2KHSO_5.KHSO_4.K_2SO_4$, purchased from Aldrich) in 20 cc $H_2O$, and the temperature was raised to 54° C. in 9 min. After the reactor and contents were held at this temperature for 9 min, 100 g of oxidized methionine lime-processed bone gelatin dissolved in 1.5 L $H_2O$ at 54° C. were added to the reactor. Next the pH was raised to 5.90, and 122.5 cc of 1M NaBr were added to the reactor. Twenty four and a half minutes after nucleation, the growth stage was begun during which 2.5M $AgNO_3$, 2.8M NaBr, and a 0.0524M suspension of AgI were added in proportions to maintain a uniform iodide level of 1.5 mole-% in the growing silver halide crystals, and the reactor pBr at the value resulting from the cited NaBr additions prior to start of nucleation and growth. This pBr was maintained until 0.825 mole of silver iodobromide had formed (constant flow rates for 40 min), at which time the excess $Br^-$ concentration was increased by addition of 105 cc of 1M NaBr, and the reactor pBr was maintained at the resulting value for the balance of grain growth. The flow rates of reactant introductions were accelerated approximately 12 fold during the remaining 64 min of grain growth. A total of 9 moles of silver iodobromide (1.5M % I) was formed. When addition of $AgNO_3$, AgI, and NaBr was complete, the resulting emulsion was coagulation washed, and pH and pBr were adjusted to storage values of 6 and 2.5, respectively.

The resulting emulsion was examined by SEM. Tabular grains accounted for greater than 99 percent of total grain projected area, the mean ECD of the emulsion grains was 1.98 μm (coefficient of variation= 34). Employing the same measurement technique as for Emulsion A, mean tabular grain thickness was determined to be 0.055 μm.

Emulsion E (Uniform 12M % Iodide)

This emulsion was precipitated by the same procedure employed for Emulsion D, except that the flow rate ratio of AgI to $AgNO_3$ was increased so that a uniform 12M % iodide silver iodobromide grain composition resulted, and the flow rates of $AgNO_3$ and NaBr during growth were decreased such that the growth time was ca. 1.93 times as long, in order to avoid renucleation during growth of this less soluble, higher iodide emulsion.

Using the analysis techniques as employed for Emulsion D, Emulsion E was determined to consist of 98 percent by number tabular grains with tabular grains accounting for more than 99 percent of total grain projected area. The emulsion grains exhibited a mean ECD of 1.60 μm (COV= 42) and a mean thickness of 0.086 μm. It was specifically noted that introducing 12 mole percent iodide throughout the precipitation had the effect of thickening the silver iodobromide tabular grains so that they no longer satisfied ultrathin tabular grain emulsion requirements.

Emulsion F (Uniform 4.125M % Iodide)

This emulsion was precipitated by the same procedure employed for Emulsion D, except that the flow rate ratio of AgI to $AgNO_3$ was increased so that a uniform 4.125M % iodide silver iodobromide composition resulted, and the flow rates of $AgNO_3$ and NaBr during growth were decreased such that the growth time was ca. 1.20 times as long, in order to avoid renucleation during growth of this less soluble, higher iodide emulsion.

Using the analysis techniques as employed for Emulsion D, Emulsion E was determined to consist of 97.8 percent by number tabular grains with tabular grains accounting for greater than 99 percent of total grain projected area. The emulsion grains exhibited a mean ECD of 1.89 μm (COV= 34) and a mean thickness of 0.053 μm.

Emulsion G (Profiled Iodide)

This emulsion was precipitated by the same procedure employed for Emulsion D, except that after 6.75 moles of emulsion (amounting to 75 percent of total silver) had formed containing 1.5M % I silver iodobromide grains, the ratio of AgI to $AgNO_3$ additions was increased so that the remaining portion of the 9 mole batch was 12M % I. During formation of this higher iodide band, flow rate, based on rate of total Ag delivered to the reactor, was approximately 25% that employed in forming Emulsion D, (total growth time was 1.19 times as long) in order to avoid renucleation during formation of this less soluble, higher iodide composition.

Using the analysis techniques as employed for Emulsion D, Emulsion E was determined to consist of 97 percent by number tabular grains with tabular grains accounting for greater than 99 percent of total grain projected area. The emulsion grains exhibited a mean ECD of 1.67 μm (COV= 39) and a mean thickness of 0.057 μm.

The composition and grain size data for Emulsions D through G are summarized below in Table IX.

TABLE IX

| Emulsion Grain Size and Halide Data | | | | |
|---|---|---|---|---|
| Emulsion | Iodide in AgIBr Grains | ECD (μm) | Thickness (μm) | Aspect Ratio |
| D | 1.5 M % I (uniform) | 1.98 | 0.055 | 36.0 |
| E | 12.0 M % I (uniform) | 1.60 | 0.086 | 18.6 |
| F | 4.125 M % I (uniform) | 1.89 | 0.053 | 35.7 |
| G | 1.5 M % I (1st 75% Ag) 12 M % I (last 25% Ag) | 1.67 | 0.056 | 29.8 |

Data in Table IX indicate that the emulsion satisfying the requirements of the invention, Emulsion G, contained grains dimensionally comparable to those of Emulsions D and F, containing uniformly distributed 1.5 or 4.125M % iodide concentrations, respectively. However, Emulsion E, which contained 12.0M % iodide uniformly distributed within the grains showed a loss in mean ECD, an increase in mean grain thickness, and a reduction in the average aspect ratio of the grains.

Sensitizations

Samples of the emulsions were next similarly sensitized to provide silver salt epitaxy selectively at corner sites on the ultrathin tabular grains of Emulsions D, E, F and G.

In each case a 0.5 mole sample of host emulsion was melted at 40° C. and its pBr was adjusted to ca. 4 with a simultaneous addition of $AgNO_3$ and KI solutions in a ratio such that the small amount of silver halide precipitated during this adjustment was 12M % I. Next, 2M % NaCl (based on the amount of silver in the ultrathin tabular grain emulsion) was added, followed by addition of Dye 1 and Dye 2, after which 6M % AgCl epitaxy was formed by a balanced double jet addition of $AgNO_3$ and NaCl solutions. Epitaxial deposition was restricted to the corners of the tabular grains.

The epitaxially sensitized emulsion was split into smaller portions to determine optimal levels of subsequently added sensitizing components, and to test effects of level variations. The post-epitaxy components included additional portions of Dyes 1 and 2, 60 mg NaSCN/mole Ag, $Na_2S_2O_3.5H_2O$ (sulfur), $KAuCl_4$ (gold), and 11.44 mg APMT/mole Ag. After all components were added, the mixture was heated to 60° C. to complete the sensitization, and after cooling to 40° C., 114.4 mg additional APMT were added.

The resulting sensitized emulsions were coated on cellulose acetate support over a gray silver antihalation layer, and the emulsion layer was overcoated with a 4.3 g/m$^2$ gelatin layer. Emulsion laydown was 0.646 g Ag/m$^2$ and this layer also contained 0.323 g/m$^2$ and 0.019 g/m$^2$ of Couplers 1 and 2, respectively, 10.5 mg/m$^2$ of 4-hydroxy-6-methyl-1,3,3A, 7-tetraazaindene ($Na^+$ salt), and 14.4 mg/m$^2$ 2-(2-octadecyl)-5-sulfohydroquinone ($Na^+$ salt), and a total of 1.08 g gelatin/m$^2$. The emulsion layer was overcoated with a 4.3 g/m$^2$ gelatin layer containing surfactant and 1.75 percent by weight, based on the total weight of gelatin, of bis(vinylsulfonyl)methane hardener.

The emulsions so coated were given 0.01" Wratten 23A™ filtered daylight balanced light exposures through a 21 step granularity step tablet (0– 3 density range), and then were developed using the Kodak Flexicolor™ C41 color negative process. Speed was measured at a density of 0.30 above $D_{min}$.

Granularity readings on the same processed strips were made according to procedures described in the *SPSE Handbook of Photographic Science and Engineering,* edited by W. Thomas, pp. 934–939. Granularity readings at each step were divided by the contrast at the same step, and the minimum contrast normalized granularity reading was recorded. Contrast normalized granularity is reported in grain units (g.u.), in which each g.u. represents a 5% change; positive and negative changes corresponding to grainier and less grainy images, respectively (i.e., negative changes are desirable). Contrast-normalized granularities were chosen for comparison to eliminate granularity differences attributable to contrast differences. Since the random dot model for granularity predicts that granularity is inversely proportional to the square root of the number of imaging centers (M. A. Kriss in *The Theory of the Photographic Process,* 4th Ed. T. H. James, ed., New York, Macmillan, 1977; p. 625), and larger grains generally are needed to achieve higher speeds, it is generally accepted that in emulsions granularity will increase at a rate of ca. 7 g.u. for each gain of 30 log speed units at constant Ag laydown and photoefficiency.

Optimizations of the sensitizations of each of the emulsions was completed as described for Emulsions A and B. Relative log speed and minimum contrast-normalized granularity for optimized sensitizations are reported in Table X.

TABLE X

| Speed and Contrast Normalized Granularity Responses | | | |
|---|---|---|---|
| Emulsion | Δ Speed | Relative Granularity | Contrast |
| D | Check | Check | 0.85 |
| E | +9 | +4.5 | 0.55 |
| F | +11 | –3.0 | 0.91 |
| G | +21 | –7.6 | 0.94 |

The data in Table X clearly demonstrate the advantage that the higher iodide laterally displaced region grain structure offers as compared to the three comparison (uniform iodide ultrathin tabular grain) emulsions when all are given corner epitaxial sensitizations. The emulsion satisfying the requirements of the invention, Emulsion G, exhibited both the highest photographic speed and contrast and the lowest image granularity and hence was clearly photographically superior to the compared emulsions of similar structure, but lacking the required iodide profile.

LATERALLY DISPLACED REGION VS. CENTRAL REGION EPITAXY

Emulsion H (Profiled Iodide, AgBr Central Region)

This emulsion was precipitated similarly as Emulsions D–G, but with the significant difference of lowered iodide concentrations in the central regions of the ultrathin tabular grains. The absence of iodide in the central region was of key importance, since, in the absence of an adsorbed site director, the portions of the major faces of the ultrathin tabular grains formed by the central region accepts silver salt epitaxy. Therefore this structure was chosen to allow comparison of central region and laterally displaced region (specifically, corner) epitaxial sensitizations, which can be formed in the absence or presence, respectively, of one or more adsorbed site directors. In addition to the noted change in halide composition, other modifications of the precipitation procedure described above for Emulsions D through G include use of NaOCl rather than Oxone™ for in situ oxidation of nucleation gelatin, increased batch size (12 rather than 9 moles), and use of a parabolic flow rate acceleration during early growth.

The first 75 percent of the silver was precipitated in the absence of iodide while the final 25 percent of the silver was precipitated in the presence of 6M % I.

Using analysis techniques described above, Emulsion H was found to consist of 98 percent tabular grains, which accounted for greater than 99 percent of total grain projected area. The emulsion exhibited a mean ECD of 2.19 μm ECD (COV = 54) and a mean grain thickness 0.056 μm.

Emulsion H/CR (Central Region Epitaxial Sensitization)

The procedure used to form epitaxy on the portions of the major faces of the ultrathin tabular grains of Emulsion H formed by the central regions was like that described above for the corner epitaxial sensitization of Emulsions D through G, but with these differences: 1) The initial pBr adjustment prior to formation of epitaxy was with $AgNO_3$ alone rather than with a simultaneous addition of $AgNO_3$ and KI. 2) The pBr was adjusted to ca. 3.5 rather than 4. 3) There were no dye additions prior to formation of epitaxy. (These differences were undertaken to eliminate corner site direction for the epitaxy.) 4) The level of AgCl epitaxy, based on the Emulsion G silver prior to epitaxial deposition was 12 rather than 6M %.

Scanning electron micrographic examination indicated that the epitaxy was deposited predominantly on the major faces of the ultrathin tabular grains.

In an effort to obtain optimum photographic performance the resulting emulsion with facial epitaxy was subjected to level variations in spectral sensitizing dye, $Na_2S_2O_3.5H_2O$, and $KAuCl_4$. Within the design space examined optimum performance was found with these levels (in mg/mole Ag): 250 Dye 1, 1025 Dye 2, 60 NaSCN, 3.13 $Na_2S_2O_3.5H_2O$, 1.10 $KAuCl_4$, 11.44 mg APMT. After adding these compounds, the resulting mixture was heated to facilitate sensitization, after which 114.4 mg APMT were added as a stabilizer. Coating format, exposure and processing were as described above for Emulsions D through G.

Speed-granularity relationships are summarized for comparison in Table XI below.

Emulsion H/LDR

(Laterally Displaced Region Epitaxial Sensitization)

The general procedure for formation of corner epitaxy was the same as described above for Emulsions D through G, except that, like Emulsion H/CR, 12 rather than 6 mole-% AgCl epitaxy was formed, and dye, sulfur, and gold levels were varied as a means toward seeking optimum photographic performance of this emulsion. Within the design space examined, optimum responses were observed for these levels in mg/mole Ag: 250 of Dye 1 and 1025 Dye 2 prior to the formation of epitaxy, and 25 mg and 102.5 mg, respectively, after formation of epitaxy, 3.13 mg $Na_2S_2O_3.5H_2O$, and 0.9 mg $KAuCl_4$.

The resulting corner epitaxially sensitized emulsion was coated, exposed, and processed identically as Emulsion H/CR.

Speed-granularity relationships are summarized for comparison in Table XI below.

TABLE XI

Speed and Contrast Normalized Granularity Responses

| Emulsion | Location of Epitaxy | Δ Speed | Relative Granularity |
|---|---|---|---|
| H/CR | Major Faces | Check | Check |
| H/LDR | Corners | +51 | +3 |

Data in Table XI demonstrate the substantial advantage of corner epitaxial sensitizations compared to those involving epitaxy distributed over the major faces of the tabular grains. Emulsion H/CR is 51 speed units faster than Emulsion H/LDR, with only a 3 g.u. penalty. This is a highly favorable speed/granularity trade; from previous discussion it is evident that the random dot model predicts ca. 11.9 g.u. increase as a penalty accompanying the 0.51 log E speed increase at constant Ag laydown, assuming an invariant photoefficiency. Thus corner epitaxy sensitization of the profiled iodide ultrathin tabular grain emulsions of the invention offers a large speed-granularity (photo-efficiency) advantage over the same profiled iodide ultrathin tabular gain emulsions, but with the silver salt epitaxy distributed over the major faces of the grains. Hence, the improved photoefficiency of the emulsions of the invention is not only a function of the iodide profiling selected, but also a function of the silver salt epitaxy and its location.

Increased Iodide in Epitaxy

Varied Iodide Sensitizations of Emulsion C

To demonstrate the relationship between silver and halide ions introduced during epitaxial sensitization and the levels of iodide found in the silver halide protrusions formed, a series of sensitizations were undertaken. In each case 0.25 mole of Emulsion C was dyed with 1715 mg of Dye 2 per Ag mole, then emulsion pBr was adjusted to 4.0 with $AgNO_3$ and KI added in relative rates so that the small amount of silver halide formed corresponded to the original composition $AgI_{0.12}Br_{0.88}$.

Silver halide epitaxy amounting to 12 mole percent of silver contained in the host tabular grains was then precipitated. Halide and silver salt solutions were added in sequence with a two mole percent excess of the chloride salt being maintained to assure precipitation of AgCl. Silver and halide additions are reported below based on mole percentages of silver in the host tabular grains. The rate of $AgNO_3$ addition was regulated to precipitate epitaxy at the rate of 6 mole percent per minute.

Sensitization C-1: 14M % NaCl was added followed by 12M % $AgNO_3$ for a nominal (input) epitaxy composition of 12M % AgCl.

Sensitization C-2: 12.08M % NaCl was added followed by 1.92M % AgI (Lippmann) followed in turn by 10.08M % $AgNO_3$ for a nominal (input) epitaxy composition of 12M % $AgI_{0.16}Cl_{0.84}$.

Sensitization C-3: 7.04M % NaCl was added followed by 5.04M % NaBr followed in turn by 1.92M % AgI (Lippmann) followed in turn by 10.08M % $AgNO_3$ for a nominal composition of 12M % $AgI_{0.16}Br_{0.42}Cl_{0.42}$.

Following the epitaxial depositions, the separately sensitized samples were subjected to chemical sensitization finishing conditions, but sulfur and gold sensitizers were withheld to avoid complicating halide analysis of the epitaxial protrusions. Finishing consisted of adding 60 mg of NaSCN and 11.4 mg of APMT per Ag mole. These additions were followed by heating the mixture to 50° C., followed by the addition of 114.4 mg of APMT per silver mole.

Analytical electron microscopy (AEM) techniques were then employed to determine the actual as opposed to nominal (input) compositions of the silver halide epitaxial protrusions. The general procedure for AEM is described by J. I. Goldstein and D. B. Williams, "X-ray Analysis in the TEM/STEM", *Scanning Electron Microscopy* 1977; Vol. 1, IIT Research Institute, March 1977, p. 651. The composition of an individual epitaxial protrusion was determined by focusing an electron beam to a size small enough to irradiate only the protrusion being examined. The selective location of the epitaxial protrusions at the corners of the host tabular grains facilitated addressing only the epitaxial protrusions. Each corner epitaxial protrusion on each of 25 grains was examined for each of the sensitizations. The results are summarized in Table XII.

TABLE XII

| | Halide in Epitaxy | | | |
|---|---|---|---|---|
| | Halide | Halide Found | | |
| Sample | Added | Cl | Br | I |
| C-1 | Cl 100% | 72.6% | 26.8% | 0.6% |
| C-2 | I 16%<br>Cl 84% | 69.4% | 28.7% | 1.9% |
| C-3 | I 16%<br>Br/Cl 42% | 28.4% | 64.5% | 7.2% |

The minimum AEM detection limit was a halide concentration of 0.5M %.

From Table XII, referring to C-1, it is apparent that, even when chloride was the sole halide added to the silver iodobromide ultrathin tabular grain emulsion during precipitation of the epitaxial protrusions, migration of iodide ion from the host emulsion into the epitaxy was low, less than 1 mole percent, but bromide ion inclusion was higher, probably due to the greater solubility of AgBr in AgCl compared to the solubility of AgI in AgCl.

Referring to C-2, when iodide was added along with chloride during epitaxial deposition, the iodide concentration was increased above 1.5M % while bromide inclusion in the epitaxy remained relatively constant.

Referring to C-3, when half of the chloride added in C-2 was replaced by bromide, the iodide concentration was dramatically increased as compared to C-2, even though the same amount of iodide was added in each sensitization.

Nominal AgCl vs. Nominal AgICl Epitaxy

Emulsion I

The emulsion prepared was a silver iodobromide emulsion containing 4,125M % I, based on total silver. A central region of the grains accounting for 75% of total silver containing 1.5M % I while a laterally displaced region accounting for the last 25% of total silver precipitated contained 12M % I.

A vessel equipped with a stirrer was charged with 9.375 L of water containing 30.0 grams of phthalic anhydride-treated gelatin (10% by weight) 3.60 g NaBr, an antifoamant, and sufficient sulfuric acid to adjust pH to 2.0 at 60° C. During nucleation, which was accomplished by an unbalanced simultaneous 30 sec. addition of $AgNO_3$ and halide (0.090 mole $AgNO_3$, 0.1095 mole NaBr, and 0.0081 mole KI) solutions, during which time reactor pBr decreased due to excess NaBr that was added during nucleation, and pH remained approximately constant relative to values initially set in the reactor solution. Following nucleation, the reactor gelatin was quickly oxidized by addition of 1021 mg of Oxone™ ($2KHSO_5.KHSO_4.K_2SO_4$, purchased from Aldrich) in 50 cc $H_2O$. After the reactor and contents were held at this temperature for 7 min, 100 g of oxidized methionine lime-processed bone gelatin dissolved in 1.5 L $H_2O$ at 54° C. was added to the reactor. Next the pH was raised to 5.90, and 12 min after completing nucleation, 196.0 cc of 1M NaBr were added to the reactor. Fourteen minutes after nucleation was completed the growth stage was begun during which 2.30M $AgNO_3$ and 2.40M NaBr solutions, and a 0.04624M suspension of AgI (Lippmann) were added in proportions to maintain a uniform iodide level of 1.5M % in the growing silver halide crystals. The reactor pBr resulted from the cited NaBr additions prior to start of and during nucleation and prior to growth. This pBr was maintained until 2.775 moles of silver iodobromide had formed (flow rate accelerated to a value 1.87 times that at the start of this segment over 26.2 min) at which time flow of the cited AgI suspension was stopped and addition of a more concentrated AgI suspension (0.4140M) was begun, and the rate of addition of $AgNO_3$ was decreased by ca. 56% as growth of this 12M % iodide portion was begun. During this final growth stage, which lasted 12.5 min, $AgNO_3$ flow rate acceleration (end flow was 1.52 times that of that at the beginning of this segment) was resumed and flow of the NaBr solution and the AgI suspension were regulated so that reactor pBr was maintained as set by NaBr additions before and during nucleation and prior to start of growth, and so that a $AgI_{0.12}Br_{0.88}$ composition was achieved. A total of 3.7 moles of silver iodobromide were formed. When additions of $AgNO_3$, AgI, and NaBr were complete, the resulting emulsion was coagulation washed, and pH and pBr were adjusted to storage values of 6 and 3.0, respectively.

The resulting emulsion was examined by SEM. Greater than 99 percent of total grain projected area was accounted for by tabular grains. The mean ECD of the emulsion grains was 0.57 μm (COY)= 54). Since this emulsion is almost exclusively tabular, the grain thickness was determined using a dye adsorption technique: The level of 1,1'-diethyl-2,2'-cyanine dye required for saturation coverage was determined, and the equation for surface area was solved assuming the solution extinction coefficient of this dye to be 77,300 L/mole-cm and its site area per molecule to be 0.566 $nm^2$.

This approach gave a mean grain thickness value of 0.043 μm.

Sensitization I-1 Nominal AgCl

The following procedure was used for epitaxy formation and sensitization and for evaluation of photographic responses: In each case a 0.5 mole sample of Emulsion I was melted at 40° C. and its pBr was adjusted to ca. 4 by simultaneous addition of $AgNO_3$ and KI solutions in a ratio such that the small amount of silver halide precipitated during this adjustment was 12M % I. Next, 2M % NaCl (based on the original amount of Emulsion I) was added, followed by addition of 1696 mg Dye 4 and 152.7 mg Dye 6 [anhydro-3,9-diethyl- 3'-(N-sulfomethylcarbamoylmethyl)oxathiacarbocyanine hydroxide] per mole Ag, after which 6M % AgCl epitaxy was formed by a balanced double jet addition of $AgNO_3$ and NaCl solutions (1 min addition time). The post-epitaxy components (cited levels are per mole total Ag) included 0.14 mg bis(2-amino-5-iodopyridinedihydroiodide) mercuric iodide, 137 mg Dye 4, 12.4 mg Dye 6, 60 mg NaSCN, 6.4 mg Sensitizer 1 (sulfur), 3 mg Sensitizer 2 (gold), and 11.4 mg APMT.

Sensitizer 1

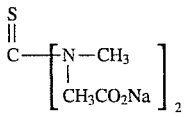

Sensitizer 2

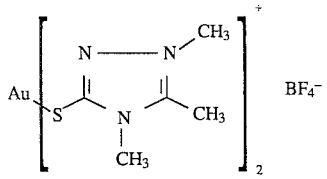

After all components were added, the mixture was heated to 50° C. for 5 min to complete the sensitization, and after cooling to 40° C., 114.35 mg additional APMT were added. The coating support was a 132 thick cellulose acetate film support that had a rem jet antihalation backing and a gelatin subbing layer (4.89 g/m$^2$), and the emulsion layer was overcoated with a 4.3 g/m$^2$ gelatin layer which also contained surfactant and 1.75 percent by weight, based on total gelatin, of bis(vinylsulfonyl)methane hardener. Emulsion laydown was 0.538 g Ag/m$^2$ and this layer also contained 0.398 g/m$^2$ and 0.022 g/m$^2$ of Couplers 3 and 4, respectively, 8.72 mg/m$^2$ of 4-hydroxy-6-methyl-1,3,3a,7-tetraazaindene ($Na^+$ salt), and 11.96 mg/m$^2$ 2-(2-octadecyl)-5-sulfohydroquinone ($Na^+$ salt), surfactant and a total of 1.08 g gelatin/m$^2$.

Coupler 3

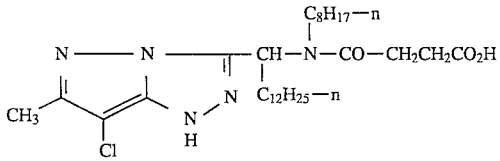

Coupler 4

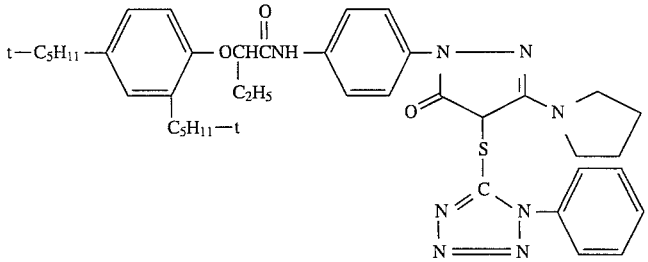

The emulsions so coated were given 0.01" Wratten 9™ filtered (>460 nm)daylight balanced light exposures through a 21 step granularity step tablet (0–3 density range), and then were developed using the Kodak Flexicolor™ C41 color negative process. Speed was measured at 0.15 above minimum density. Granularity readings on the same processed strips were made as described for Emulsions D through G.

Sensitization I-2 Nominal AgICl

The sensitization, coating and evaluation procedures were the same as for Sensitization D-1, except that the halide salt solution for double jet formation of epitaxy was 92M % Cl added as NaCl and 8 M % I added as KI.

The performance comparisons of Sensitizations I-1 and I-2 are reported in Table XIII.

TABLE XIII

Performance Comparisons of Varied Iodide in Epitaxy

| Nominal Epitaxy Halide | $D_{min}$ | Speed | Contrast | Contrast Normalized Granularity* |
|---|---|---|---|---|
| Cl | 0.10 | 198 | 1.15 | Check |
| Cl 0.92 I 0.08 | 0.08 | 196 | 1.39 | −3.1 g.u. |

*Average of readings over 4 exposure steps near minimum granularity

Emulsion J

The emulsion prepared was a silver iodobromide emulsion containing 4.125M % I, based on total silver. A central region of the grains accounting for 75% of total silver contained 1.5M % I while a laterally displaced region accounting for the last 25% of total silver precipitated contained 12M % I.

A vessel equipped with a stirrer was charged with 6 L of water containing 3.75 g lime-processed bone gelatin, 4.12 g NaBr, an antifoamant, and sufficient sulfuric acid to adjust pH to 1.86, at 39° C. During nucleation, which was accomplished by balanced simultaneous 4 sec. addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin methionine was quickly oxidized by addition of 128 mg of Oxone™ (2KHSO5.KHSO$_4$.K$_2$SO$_4$, purchased from Aldrich) in 50 cc $H_2O$, and the temperature was raised to 54° C. in 9 min. After the reactor and contents were held at this temperature for 9 min, 100 g of oxidized methionine lime-processed bone gelatin dissolved in 0.5 L $H_2O$ at 54° C. were added to the reactor. Next the pH was raised to 5.87, and 107.0 cc of 1M NaBr were added to the reactor. Twenty two minutes after nucleation was started, the growth stage was begun during which 1.6M $AgNO_3$, 1.75M NaBr and a 0.0222M suspension of AgI (Lippmann) were added in proportions to maintain a uniform iodide level of 1.5M % in the growing silver halide crystals, and the reactor pBr at the value resulting from the cited NaBr additions prior to start of nucleation and growth. This pBr was maintained until 0.825 mole of silver iodobromide had formed (constant flow rates for 40 min), at which time the excess $Br^-$ concentration was increased by addition of 75 cc of 1.75M NaBr, the reactor pBr being maintained at the resulting value for the balance of the growth. The flow rate of $AgNO_3$ was accelerated to approximately 8.0 times its starting value during the next 41.3 min of growth. After 4.50 moles of emulsion had formed (1.5M % I), the ratio of flows of AgI to $AgNO_3$ was changed such that the remaining portion of the 6 mole batch was 12M % I. At the start of the formation of this high iodide band, the flow rate, based on rate of total Ag delivered to the reactor, was initially decreased to approximately 25% of the value at the end of the preceding segment in order to avoid renucleation during formation of this less soluble, higher iodide band, but the flow rate was doubled from start to finish of the portion of the run. When addition of $AgNO_3$, AgI and NaBr was complete, the resulting emulsion was coagulation washed and pH and pBr were adjusted to storage values of 6 and 2.5, respectively.

Particle size and thickness were determined by methods described for Emulsion H. Mean grain ECD was 1.30 μm (COV= 47), and thickness was 0.052 μm. Tabular grains accounted for >99% of total grain projected area.

Sensitization J-1 Nominal AgCl

A 0.5 mole sample of Emulsion J was melted at 40° C., and its pBr was adjusted to ca. 4 by simultaneous addition of. $AgNO_3$ and KI solutions in a ratio such that the small amount of silver halide precipitated during this adjustment was 12M % I. Next, 2M % NaCl (based on silver in Emulsion J) was added, followed by addition of 1170 mg Dye 4 and 117.9 mg Dye 6 and 119 mg of Dye 7 [anhydro-9-ethyl-5,6-dimethoxy-5'-phenyl-3,3'-bis(sulfopropyl)oxacarbocyanine hydroxide, sodium salt] per mole Ag, after which 6M % AgCl epitaxy was formed by a balanced double jet addition of $AgNO_3$ and NaCl solutions (1 min addition time). After formation of epitaxy, the resulting emulsion was chill-set and then 0.04 mole portions of it were taken for remaining steps in the sensitization. This allowed variations in levels of sensitizers in order to determine optimum treatment combinations. The post-epitaxy components (cited levels are per mole Ag) included Dye 4, Dye 6 and Dye 7, 60 mg NaSCN/mole Ag, Sensitizer 1 (sulfur), Sensitizer 2 (gold), and 8.0 mg N-methylbenzothiazolium iodide. After all components were added, the mixture was heated to 50° C. for 5 min to complete the sensitization, and after cooling to 40° C., 114.35 mg additional APMT was added.

Coating, exposure, processing and evaluation was as described above for the sensitizations of Emulsion H. Within the design space explored, the optimum speed/$D_{min}$ ($D_{min}$= 0.10 or less) response was observed for these post sensitization additions (levels in mg/mole Ag): 243 mg Dye 4, 12.15 mg Dye 6, 12.2 mg Dye 7, 2.68 mg Sensitizer 1, and 1.35 mg Sensitizer 2.

Sensitization J-2 Nominal AgICl

The procedure was identical to Sensitization J-1, except that the halide salt solution used to form epitaxy was 84M % NaCl and 16M % KI—i.e., optimum photographic responses were observed at the same sensitizer levels as for the nominal AgCl epitaxial sensitization of Sensitization E-2.

The performance comparisons of Sensitizations J-1 and J-2 are reported in Table XIV.

TABLE XIV

Performance Comparisons of Varied Iodide in Epitaxy

| Nominal Epitaxy Halide | $D_{min}$ | Speed | Contrast | Contrast Normalized Granularity* |
|---|---|---|---|---|
| Cl | 0.10 | 240 | 1.42 | Check |
| Cl 0.84 I 0.16 | 0.08 | 241 | 1.58 | −2.8 g.u. |

*Average of readings over 4 exposure steps near minimum granularity

From a comparison of Tables XIII and XIV it is apparent that the increased iodide in the silver halide epitaxy increased contrast and decreased granularity, and the further increase in iodide in Table XIV as compared to Table XIII further increased contrast.

Emulsion K

The emulsion prepared was a silver iodobromide emulsion containing 4.125M % I, based on total silver. A central region of the grains accounting for 74% of total silver contained 1.5M % I while a laterally displaced region accounting for the last 26% of total silver precipitated contained 12M % I.

A vessel equipped with a stirrer was charged with 6 L of water containing 3.75 g lime-processed bone gelatin, 4.12 g NaBr, an antifoamant, and sufficient sulfuric acid to adjust pH to 5.41, at 39° C. During nucleation, which was accomplished by balanced simultaneous 4 sec. addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the methionine in the reactor gelatin was quickly oxidized by addition of 0.656 cc of a solution that was 4.74M % NaOCl, and the temperature was raised to 54° C. in 9 min. After the reactor and contents were held at this temperature for 9 min, 100 g of oxidized methionine lime-processed bone gelatin dissolved in 1.5 L $H_2O$ at 54° C., and 122.5 cc of 1M NaBr were added to it (after which pH was ca. 5.74). Twenty four and a half minutes after nucleation, the growth stage was begun during which 2.50M $AgNO_3$, 2.80 M NaBr, and a 0.0397M suspension of AgI (Lippmann) were added in proportions to maintain a uniform iodide level of 1.5M % in the growing silver halide crystals, and the reactor pBr at the value resulting from the cited NaBr additions prior to the start of nucleation and growth. This pBr was maintained until 0.825 mole of silver iodobromide had formed (constant flow rates for 40 min), at which time the excess $Br^-$ concentration was increased by addition of 105 cc of 1M NaBr, the reactor pBr being maintained at the resulting value for the balance of the growth. The flow rate of $AgNO_3$ was accelerated to approximately 10 times the starting value in this segment during the next 52.5 min of growth. After 6.69 moles of emulsion had formed (1.5M % I), the ratio of flow of AgI to $AgNO_3$ was changed such that the remaining portion of the 9 mole batch was 12M % I. At the start of the formation of this high iodide band, growth reactant flow rate, based on rate of total Ag delivered to the reactor, was initially decreased to approximately 25% of the value at the end of the preceding segment in order to avoid renucleation during formation of this less soluble, higher iodide composition band, but it was accelerated (end flow 1.6 times that at the start of this segment) during formation of this part of the emulsion. When addition of $AgNO_3$, AgI and NaBr was complete, the resulting emulsion was coagulation washed and pH and pBr were adjusted to storage values of 6 and 2.5, respectively.

Particle size and thickness were determined by methods described for Emulsion H. Mean grain ECD was 1.50 μm (COV= 53), and thickness was 0.060 μm. Tabular grains accounted for >99% of total grain projected area.

Sensitization K-1 Nominal AgCl

A 0.5 mole sample of Emulsion K was melted at 40° C. and its pBr was adjusted to ca. 4 by simultaneous addition of $AgNO_3$ and KI solutions in a ratio such that the small amount of silver halide precipitated during this adjustment was 12M % I. Next, 2M % NaCl (based on the original amount of silver in the Emulsion F sample) was added, followed by addition of Dye 4 and Dye 6 (1173 and 106 mg/mole Ag, respectively), after which 6 mole-% epitaxy was formed as follows: A single-jet addition of 6M % NaCl, based on the original amount of host emulsion, was made, and this was followed by a single-jet addition of 6M % $AgNO_3$. The $AgNO_3$ addition was made in 1 min. The post-epitaxy components added were 60 mg NaSCN/mole Ag, $Na_2S_2O_3.5H_2O$ (sulfur sensitizer) and $KAuCl_4$ (gold sensitizer), and 3.99 mg 3-methyl-1,3-benzothiazolium iodide/mole Ag. Sulfur and gold sensitizer levels were the best obtained from several trial sensitizations. After all components were added, the mixture was heated to 60° C. for 8 min to complete the sensitization. After cooling to 40° C., 114.35 mg APMT/mole Ag were added. The optimum sensitization was 2.9 mg/M Ag $Na_2S_2O_3.5H_2O$ and 1.10 mg/M Ag $KAuCl_4$.

Coating, exposure, processing and evaluation were conducted similar as described for Emulsion H, except that Coupler 5 (0.323 g/m$^2$) was substituted for Coupler 3, and the laydown of Coupler 2 was 0.016 g/m$^2$.

Coupler 5

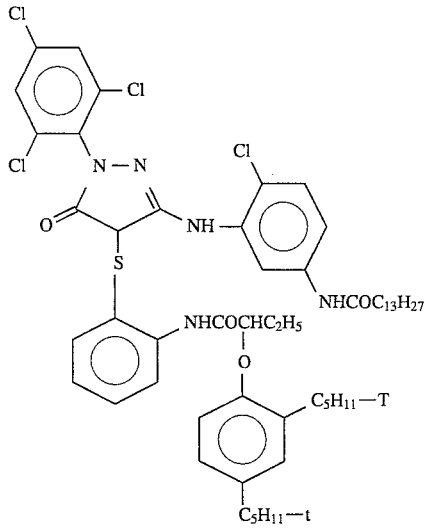

Sensitization K-2 Nominal AgIBrCl

The procedure was identical to Sensitization K-1, except that instead of the sequential single jet additions of 6M % NaCl and 6M % $AgNO_3$ the following were added sequentially: 2.52M % NaCl, 2.52M % NaBr, 0.96M % AgI (Lippmann) and 5.04M % $AgNO_3$. The percentages are based on silver provided by Emulsion K. The optimum sensitization was 2.3 mg/M Ag $Na_2S_2O_3.5H_2O$ and 0.80 mg/M Ag $KAuCl_4$.

The performance comparisons of Sensitizations K-1 and K-2 are reported in Table XV.

TABLE XV

Performance Comparisons of Varied Iodide in Epitaxy

| Nominal Epitaxy Halide | $D_{min}$ | Speed | Contrast | Contrast Normalized Granularity* |
|---|---|---|---|---|
| Cl | 0.09 | 100 | 0.51 | Check |
| Cl 0.42<br>Br 0.42<br>I 0.16 | 0.08 | 106 | 0.56 | −3.5 g.u. |

*Average of readings over 4 exposure steps near minimum granularity

From Table XV it is apparent that the increased bromide and iodide in the silver halide epitaxy increased contrast and decreased granularity.

DOPANT OBSERVATIONS

Dopant Thickening of Ultrathin Tabular Grains

Emulsion L

A silver iodobromide (2.6M % I, uniformly distributed) emulsion was precipitated by a procedure similar to that employed by Antoniades et al for precipitation of Emulsions TE-4 to TE-11. Greater than 99 percent of total grain projected area was accounted for by tabular grains. The mean ECD of the grains was 2.45 μm and the mean thickness of the grains was 0.051 μm. The average aspect ratio of the grains was 48. No dopant was introduced during the precipitation of this emulsion.

Emulsion M

The same precipitation procedure employed for the preparation of Emulsion L was employed, except that, prior to the start of silver ion introduction into the reaction vessel, 440 molar parts per million (mppm), based on total silver used to form the emulsion, of $K_4Ru(CN)_6$ were introduced into the reaction vessel.

Greater than 99 percent of total grain projected area was accounted for by tabular grains. The mean ECD of the grains was 2.02 μm, and the mean thickness of the grains was 0.069 μm. The average aspect ratio of the grains was 29.3.

The objectionable increase in the thickness of the ultrathin tabular grains was entirely attributable to the introduction of the-ruthenium hexacyanide dopant into the tabular grain structure.

Emulsion N

The Emulsion M preparation procedure was repeated, except that the concentration of $K_4Ru(CN)_6$ was increased to 880 mppm, which was a concentration level expected to further enhance photographic speed.

Greater than 99 percent of total grain projected area was accounted for by tabular grains. The mean ECD of the grains was 2.24 μm, but the average aspect ratio dropped to 31, and the mean thickness of the grains was 0.073 μm, well above the maximum thickness permissible for an ultrathin tabular grain emulsion. This emulsion further demonstrates the adverse thickening of tabular grains that can result from incorporating the dopant in the tabular grains. In other emulsion precipitations tabular grain thickening was obviated or minimized by a distributed post-nucleation introduction of dopant during precipitation, but this, of course, merely confirmed that dopant introduction during ultrathin tabular grain precipitation could be practiced only with restricted choices for incorporation.

Speed Enhancements by Dopant in Epitaxy

Emulsion O (Graded Iodide Host Tabular Grains)

A reaction vessel equipped with a stirrer was charged with 6 L of water containing 3.75 g of lime-processed bone gelatin, 4.12 g NaBr, an antifoamant and sufficient sulfuric acid to adjust pH to 5.42 at 39° C.

Nucleation was accomplished by a balanced simultaneous 4 second addition of 2.5M $AgNO_3$ and 2.5M halide (98.5M % Br and 1.5M % I, added as NaBr and KI, respectively) solutions in an amount sufficient to form 0.01335 mole of silver iodobromide. Both pBr and pH remained at or near the values initially set in the reaction vessel.

Following nucleation the methionine portion of the gelatin in the reaction vessel was oxidized by the introduction of 50 cc of a 0.062 percent by weight solution of NaOCl, and the temperature within the reaction vessel was raised to 54° C. in 9 minutes. After holding at this temperature for 9 minutes, 100 g of oxidized methionine lime-processed bone gelatin dissolved in 1.5 L $H_2O$ at 54° C. were added to the reaction vessel. Twenty four and a half minutes after nucleation the growth stage was begun during which 2.5 M $AgNO_3$, 2.8M NaBr and a 0.0394M suspension of AgI (Lippmann) were added in proportions to maintain a uniform iodide level of 1.5M % in the growing silver iodobromide grains and to maintain the pBr in the reaction vessel approximately constant. This pBr was maintained until 0.826 mole of silver iodobromide had formed employing constant flow rates for 40 minutes, at which time the stoichiometric excess $Br^-$ concentration was increased by addition of 105 cc of 1M NaBr. The reaction vessel was maintained at the resulting pBr value for the balance of grain growth. The flow rate of $AgNO_3$ was accelerated during the next 52.5 min, so that end flow was about 10 times greater than at the start of this segment, by which time 6.75 moles $AgBr_{0.985}I_{0.015}$ had formed. In the final growth segment, flow rates of $AgNO_3$, AgI and NaBr were continued, but with a more concentrated (0.341M) suspension of AgI, and with a reduced initial flow rate of 2.5M $AgNO_3$ (0.25 times as great as at the end of the 1.5M % I growth). During this growth segment the $AgNO_3$ flow rate was accelerated so that the final flow rate was 1.6 times that at the start. The relative flow rates of $AgNO_3$, AgI and NaBr were modulated so as to maintain the pBr from the previous growth segment and to achieve an iodide concentration 12M %, based on silver, during precipitation of the final 2.25 moles of silver.

After the final growth segment was completed, the emulsion was cooled to 40° C. and coagulation washed. pH and pBr were then adjusted to storage values of 6 and 2.5, respectively.

The resulting tabular grain silver iodobromide emulsion contained an iodide concentration of 1.5 M % in the first 75 percent of the grain to precipitate and 12M % in the last 25 percent of the grain to precipitate. Grain characteristics were measured as reported for Emulsion A. Greater than 99 percent of total grain projected area was accounted for by tabular grains. The mean ECD of the grains was 1.50 μm (COV= 52). The mean thickness of the tabular grains was 0.060 μm.

Emulsion P (Graded Iodide Host Tabular Grains)

A reaction vessel equipped with a stirrer was charged with 6.75 L of water containing 4.21 g of lime-processed bone gelatin, 4.63 g NaBr, an antifoamant and sufficient sulfuric acid to adjust pH to 1.77 at 39° C.

Nucleation was accomplished by a balanced simultaneous 4 second addition of 2.4M $AgNO_3$ and 2.4M halide (98.5M % Br and 1.5M % I, added as NaBr and KI, respectively) solutions in an amount sufficient to form 0.0150 mole of silver iodobromide. Both pBr and pH remained at or near the values initially set in the reaction vessel.

Following nucleation the methionine portion of the gelatin in the reaction vessel was oxidized by the introduction of 50 cc of a 0.07 percent by weight solution of NaOCl, and the temperature within the reaction vessel was raised to 54° C. in 9 minutes. After holding at this temperature for 6 minutes, 100 g of oxidized methionine lime-processed bone gelatin dissolved in 1.5 L $H_2O$ (also containing 0.165 mole of NaOH) at 54° C. were added to the reaction vessel, followed by a pH adjustment to 5.85. Twenty four and four tenths minutes after nucleation 333.6 cc of a 1M halide solution (33M % NaBr and 67M % NaCl) were added to the reaction vessel. One minute thereafter the growth stage was begun during which 3.0M $AgNO_3$, 3.33M NaBr and a 0.181M suspension of AgI (Lippmann) were added in proportions to maintain a uniform iodide level of 4.125M % in the growing silver iodobromide grains and to maintain the pBr in the reaction vessel approximately constant. This pBr was maintained until 0.635 mole of silver iodobromide had formed, at which time the stoichiometric excess $Br^-$ concentration was increased by addition of 147.4 cc of 1.5M NaBr. The reaction vessel was maintained at the resulting pBr value for the balance of grain growth. The flow rates of $AgNO_3$, AgI and NaBr were continued until 6.81 moles of $AgI_{0.04125}Br0.95875$ had formed in the reaction vessel (105.6 min, accelerated flow so that the end flow rate of $AgNO_3$ was 9.6 times that at the start).

In the final growth segment the addition of $AgNO_3$, AgI and NaBr was continued, but with a more concentrated (0.527M) suspension of AgI, and with a reduced initial flow rate of 3.0M $AgNO_3$ (0.49 time as great as at the end of the 4.125M % I growth). During this growth segment the $AgNO_3$ flow rate was held constant, and the relative flow rates of $AgNO_3$, AgI and NaBr were controlled to maintain the pBr from the previous growth segment and to achieve an iodide concentration 12M %, based on silver, during precipitation of the final 2.25 moles of silver.

After the final growth segment was completed, the emulsion was cooled to 40° C. and coagulation washed. pH and pBr were then adjusted to storage values of 6 and 2.5, respectively.

The resulting tabular grain silver iodobromide emulsion contained an iodide concentration of 4.125M % in the first 75 percent of the grain to precipitate and 12M % in the last 25 percent of the grain to precipitate. Grain characteristics were measured as reported for Emulsion A. Greater than 99 percent of total grain projected area was accounted for by tabular grains. The mean ECD of the grains was 1.79 μm. The mean thickness of the tabular grains was 0.056 μm.

Epitaxial Sensitizations

Samples of Emulsions O and P were next sensitized employing epitaxial depositions with and without dopant.

A 0.5 mole sample of the emulsion was melted at 40° C. and its pBr was adjusted to ca. 4 with a simultaneous addition of $AgNO_3$ and KI solutions in a ratio such that the small amount of silver halide precipitated during this adjustment was 12% I. Next, 2M % NaCl (based on the original amount of silver iodobromide host) was added, followed by addition of spectral sensitizing dyes, after which 6M % of silver iodobromochloride epitaxy was formed by the following sequence of additions: 2.52M % $Cl^-$ added as $CaCl_2$ solution, 2.52M % $Br^-$ added as NaBr solution, 0.96M % $I^-$ added as AgI (Lippmann) suspension, and 5.04M % $AgNO_3$. In those samples to which a shallow electron trapping dopant, $K_4Ru(CN)_6$ (SET-2), was incorporated in the sensitization epitaxy, the dopant was added after NaBr and before $AgNO_3$.

For red sensitizations Dye 1 and anhydro- 5,5'-dichloro-9-ethyl-3,3'-bis(2-hydroxy-3-sulfopropyl)thiacarbocyanine hydroxide, triethylammonium salt, Dye 7, were used, and for green sensitizations Dyes 3 and 4 were used.

The epitaxially sensitized emulsion samples were split into smaller portions to determine optimal levels of subsequently added sensitizing components. The post-epitaxy components included 0.75 mg 4,4'-phenyl disulfide diacetanilide, additional portions of the same sensitizing dyes previously employed, 60 mg NaSCN/Ag mole, Sensitizer 1 (sulfur sensitizer), Sensitizer 2 (gold sensitizer), 5.72 mg APMT/Ag mole (red sensitized emulsions only), and 3.99 mg 3-methyl-1,3-benzothiazolium iodide/Ag mole (green sensitized emulsions only). After all post-epitaxy sensitizing components were added, the mixture was heated to 50° C. for 5 minutes to complete the sensitization. After cooling to 40° C., an additional 114.35 mg AMPT/Ag mole were added.

The red sensitized emulsions were coated on a cellulose acetate film support over a gray silver antihalation layer. The green sensitized emulsions were coated on a similar support, with a 4.89 g gelatin/$m^2$ subbing layer and, instead of the gray silver antihalation layer, the support carried a rem jet antihalation layer on its back side.

Emulsion laydown was 0.646 and 0.538 g Ag/$m^2$ for the red and green sensitized emulsions, respectively. Each emulsion layer contained, surfactant, 1.75 g/Ag mole 4-hydroxy-6-methyl-1,3,3a,7-tetraazaindene ($Na^+$ salt) and 2.40 g/Ag mole 2-(2-octadecyl)-5-sulfo-hydro-quinone ($Na^+$ salt), dye-forming couplers, and a total of 1.08 g gelatin/$m^2$. For the red sensitized emulsion samples Couplers 1 and 2 were used at 0.323 and 0.019 g/$m^2$, respectively. For the green sensitized emulsion samples Couplers 4 and 5 were used at 0.016 and 0.323 g/$m^2$, respectively. Each emulsion layer was overcoated with a 4.3 g/$m^2$ gelatin layer that contained surfactant and 1.75 weight percent, based on total gelatin coated, of bis(vinylsulfonyl)methane hardener.

The emulsions were given a 0.01 sec exposure balanced daylight exposure. The red sensitized coatings were exposed through a Wratten™ 23A (>560 nm transmission) filter, and the green sensitized coatings were exposed through a Wratten™ 9 (>460 nm transmission) filter. The exposures were taken through a 21 step granularity step tablet (0–3 density range), and then were developed using the Kodak Flexicolor™ C41 color negative process. Speed was measured at 0.15 above minimum density. Granularity readings on the same processed strips were made as described for Emulsions D through G.

Samples of Emulsion O were selected as being representative of emulsions according to the invention optimally sensitized to the green region of the spectrum. Each sample contained, per mole of Ag, 223 mg of Dye 1, 961 mg of Dye 7, 2.25 mg of the sulfur sensitizer and 0.79 mg of the gold sensitizer. Samples differing solely by the presence or absence of 30 mppm $K_4Ru(CN)_6$ per mole of host emulsion present during epitaxial deposition are compared in Table XVI below. The addition of the dopant did not affect the thickness of the tabular grains, nor did it have any affect on granularity.

TABLE XVI

Effect of Shallow Electron Traps in Epitaxy of Green Sensitized Ultrathin Tabular Grain Emulsion

| SET-2 mppm | Relative Log Speed | Dmin |
|---|---|---|
| 0 | 100 | 0.15 |
| 30 | 111 | 0.18 |

A significant speed increase of 0.11 log E was realized to result from incorporation of the shallow electron trap imparting dopant at a concentration of only 30 molar parts per million parts of host emulsion Ag. Except for the slight (0.03) increase in minimum density there were no offsetting performance disadvantages. No increase in the thickness of the ultrathin tabular grains was observed, nor was any increase in granularity observed. Further, the increment of speed provided by the shallow electron trap dopant was in addition to incremental speed increases provided by the graded iodide profile of the host ultrathin tabular grains and the inclusion of increased levels of iodide in the epitaxy, previously demonstrated.

Samples of Emulsion P were selected as being representative of emulsions according to the invention optimally sensitized to the red region of the spectrum. Each sample contained, per mole of Ag, 336 mg of Dye 3, 973 mg of Dye 4, 2.30 mg of the sulfur sensitizer and 0.84 mg of the gold sensitizer. Samples differing solely by the presence or absence of 30 mppm $K_4Ru(CN)_6$ per mole of host emulsion Ag during epitaxial deposition are compared in Table XVII below. The addition of the dopant did not affect the thickness of the tabular grains, nor did it have any affect on granularity.

TABLE XVII

Effect of Shallow Electron Traps in Epitaxy of Red Sensitized Ultrathin Tabular Grain Emulsion

| SET-2 mppm | Relative Log Speed | Dmin |
|---|---|---|
| 0 | 100 | 0.06 |
| 30 | 109 | 0.06 |

A significant speed increase of 0.09 log E was realized to result from incorporation of the shallow electron trap imparting dopant at a concentration of only 30 molar parts per million parts of host emulsion Ag. No offsetting performance disadvantages were observed. No increase in the thickness of the ultrathin tabular grains was observed, no increase in minimum density was observed, nor was any increase in granularity observed. Further, the increment of speed provided by the shallow electron trap dopant was in addition to incremental speed increases provided by the graded iodide profile of the host ultrathin tabular grains and the inclusion of increased levels of iodide in the epitaxy, previously demonstrated.

The invention has been described in detail with particular reference to preferred embodiments thereof, but it will be understood that variations and modifications can be effected within the spirit and scope of the invention.

What is claimed is:

1. A radiation sensitive emulsion comprised of (1) a dispersing medium, (2) silver halide grains including tabular grains, said tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include silver halide protrusions forming epitaxial junctions with the tabular grains, the protrusions (a) being located on up to 50 percent of the surface area of the tabular grains, (b) having a higher overall solubility than at least that portion of the tabular grains forming epitaxial junctions with the protrusions, (c) forming a face centered cubic crystal lattice, and (d) including a photographically useful dopant.

2. An improved emulsion according to claim wherein the dopant includes a metal ion chosen from Groups 2 to 15.

3. An emulsion according to claim wherein the dopant is chosen to reduce reciprocity failure.

4. An emulsion according to claim 2 wherein the dopant is chosen to increase photographic speed.

5. An emulsion according to claim wherein the metal ion displaces silver in the crystal lattice of the protrusions, exhibits a positive valence of from 2 to 5, has its highest energy electron occupied molecular orbital filled and its lowest energy unoccupied molecular orbital at an energy level higher than the lowest energy conduction band of the silver halide crystal lattice forming the protrusions.

6. An emulsion according to claim wherein the metal ion is lanthanum, zinc, cadmium, gallium, indium, thallium, germanium, tin, lead or bismuth.

7. An emulsion according to claim 6 wherein the metal ion is zinc, cadmium, indium, lead or bismuth.

8. An emulsion according to claim 1 wherein the protrusions contain at least a 10 mole percent higher chloride concentration than the tabular grains.

9. An emulsion according to claim 8 wherein the protrusions contain at least 20 mole percent higher chloride ion concentrations than said tabular grains.

10. An emulsion according to claim 1 where the epitaxially deposited silver halide protrusions are located on less than 25 percent of the tabular grain surfaces.

11. An emulsion according to claim 10 wherein the silver salt is located on less than 10 percent of the tabular grain surfaces.

12. An emulsion according to claim 10 wherein the epitaxially deposited silver halide protrusions are located on less than 5 percent of the tabular grain surfaces.

13. An emulsion according to claim 1 wherein the tabular grains account for greater than 97 percent of total grain projected area.

14. An emulsion according to claim 1 wherein the spectral sensitizing dye exhibits an absorption peak at wavelengths longer than 430 nm.

15. An emulsion according to claim 14 wherein the spectral sensitizing dye is a green or red spectral sensitizing dye.

16. An emulsion according to claim 15 wherein the spectral sensitizing dye is a J-aggregated cyanine dye.

17. A radiation-sensitive emulsion comprised of (1) a dispersing medium, (2) silver halide grains including tabular grains, said tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and (3) a spectral sensitizing dye adsorbed to the surfaces of the tabular grains, wherein the surface chemical sensitization sites include silver halide protrusions forming epitaxial junctions with the tabular grains, the protrusions (a) being located on up to 50 percent of the surface area of the tabular grains, (b) having a higher overall solubility than at least that portion of the tabular grains forming epitaxial junctions with the protrusions, (c) forming a face centered cubic crystal lattice, and (d) including a dopant for increasing photographic speed and the dopant is a coordination complex that (a) displaces ions in the silver halide crystal lattice of the protrusions and exhibits a net valance more positive than the net valence of the ions it displaces, (b) contains at least one ligand that is more electronegative than any halide ion, (c) contains a metal ion having a positive valence of from +2 to +4 and having its highest energy electron occupied molecular orbital filled, and (d) has its lowest energy unoccupied molecular orbital at an energy level higher than the lowest energy conduction band of the silver halide crystal lattice forming the protrusions.

18. An emulsion according to claim 17 wherein the metal ion is gallium, indium or a group VIII metal ion.

19. An emulsion according to claim 18 wherein the metal ion is chosen from among $Fe^{+2}$, $Ru^{+2}$, $Os^{+2}$, $Co^{+3}$, $Rh^{+3}$, $Ir^{+3}$, $Pd^{+4}$ and $Pt^{+4}$.

20. An emulsion according to claim 17 wherein the coordination complex is a hexacoordination complex that displaces a silver ion and six halide ions in the silver halide crystal lattice and exhibits a net negative charge of from −2 to −4.

21. An emulsion according to claim 20 wherein at least four of the ligands in the hexacoordination complex are anionic and at least three of the ligands being more electronegative than any halide ligand.

22. An emulsion according to claim 21 wherein the hexacoordination complex contains from 1 to 6 cyano ligands.

23. A photographic element comprised of a support, a first silver halide emulsion layer coated on the support and sensitized to produce a photographic record when exposed to specular light within the minus blue visible wavelength region of from 500 to 700 nm, and a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an improved emulsion according to any one of claims 1 to 19 inclusive.

* * * * *

UNITED STATES PATENT AND TRADEMARK OFFICE

CERTIFICATE OF CORRECTION

PATENT NO. : 5,503,970

DATED : April 2, 1996

INVENTOR(S) : Myra T. Olm, Xin Wen, Richard L. Daubendiek, Donald L. Black, Timothy R. Gersey, Joseph G. Lighthouse and Robert D. Wilson It is certified that error appears in the above-indentified patent and that said Letters Patent is hereby corrected as shown below:

In the Claims:

Column 47,

2. An emulsion according to claim 1 wherein the dopant includes a metal ion chosen from groups 2 to 15.

3. An emulsion according to claim 2 wherein the dopant is chosen to reduce reciprocity failure.

5. An emulsion according to claim 4 wherein the metal ion displaces silver in the crystal lattice of the protrusions, exhibits a positive valence of from 2 to 5, has its highest energy electron occupied molecular orbital filled and its lowest energy unoccupied molecular orbital at an energy level higher than the lowest energy conduction band of the silver halide crystal lattice forming the protrusions.

UNITED STATES PATENT AND TRADEMARK OFFICE

CERTIFICATE OF CORRECTION

PATENT NO. : 5,503,970

DATED : April 2, 1996

INVENTOR(S) : Myra T. Olm, Xin Wen, Richard L. Dauendiek, Donald L. Black, Timothy R. Gersey, Joseph G. Lighthouse and Robert D. Wilson It is certified that error appears in the above-indentified patent and that said Letters Patent is hereby corrected as shown below:

Cont. Column 47,

6. An emulsion according to claim 5 wherein the metal ion is lanthanum, zinc, cadmium, gallium, indium, thallium, germanium, tin, lead or bismuth.

Signed and Sealed this

Ninth Day of July, 1996

*Attest:*

Bruce Lehman

BRUCE LEHMAN

*Attesting Officer*

*Commissioner of Patents and Trademarks*